US010821763B2

(12) United States Patent
Adamson et al.

(10) Patent No.: US 10,821,763 B2
(45) Date of Patent: Nov. 3, 2020

(54) METHODS OF ROUGHENING A SURFACE OF A PRINTING FORM PRECURSOR AND PRINTING USING A ROUGHENED PRINTING FORM PRECURSOR

(71) Applicant: Shenzhen Zhong Chuang Green Plate Technology Co., Ltd., Shenzhen (CN)

(72) Inventors: John David Adamson, Cockermouth Cumbria (GB); Peter Andrew Reath Bennett, Cockermouth Cumbria (GB); Dun Liu, Cockermouth Cumbria (GB)

(73) Assignee: Shenzhen Zhong Chuang Green Plate Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/577,460

(22) PCT Filed: May 26, 2016

(86) PCT No.: PCT/GB2016/051530
§ 371 (c)(1),
(2) Date: Nov. 28, 2017

(87) PCT Pub. No.: WO2016/189316
PCT Pub. Date: Dec. 1, 2016

(65) Prior Publication Data

US 2018/0134059 A1 May 17, 2018

(30) Foreign Application Priority Data

May 28, 2015 (GB) ..... 1509208.3

(51) Int. Cl.
*B41N 3/03* (2006.01)
*B41C 1/10* (2006.01)
*B41M 1/06* (2006.01)

(52) U.S. Cl.
CPC ..... *B41N 3/032* (2013.01); *B41C 1/1016* (2013.01); *B41C 1/1041* (2013.01); *B41M 1/06* (2013.01)

(58) Field of Classification Search
None
See application file for complete search history.

(56) References Cited

U.S. PATENT DOCUMENTS 5,013,399 A 5/1991 Uesugi et al.
2001/0003032 A1 6/2001 Harada et al.
(Continued)

FOREIGN PATENT DOCUMENTS

CA 926471 A 5/1973
EP 1302313 A2 4/2003
(Continued)

OTHER PUBLICATIONS

Search Report for Corresponding GB Application No. GB1509208.3 dated Dec. 1, 2015, 6 pages.
(Continued)

*Primary Examiner* — Joshua D Zimmerman
(74) *Attorney, Agent, or Firm* — Hoffman Warnick LLC

(57) ABSTRACT

A method of roughening a surface of a printing form precursor. The method comprises subjecting at least a part of the surface to energy in the form of pulses of electromagnetic radiation to produce a uniformly hydrophilic roughened surface on at least a part of the printing form precursor and optionally converting the uniformly hydrophilic roughened surface of the printing form precursor to a uniformly hydrophobic roughened surface. The method is useful for providing a surface for use in a subsequent imaging and/or printing process in lithographic printing. Methods of providing a printing form comprising an image formed of hydrophobic regions and hydrophilic regions using said
(Continued)

method and a method of printing using said method are also described, as are printing forms so produced and imaging devices and apparatus for carrying out the said methods.

14 Claims, 2 Drawing Sheets

(56) References Cited

U.S. PATENT DOCUMENTS

| | | | | |
|---|---|---|---|---|
| 2003/0200886 | A1 | 10/2003 | Vermeersch et al. | |
| 2011/0174178 | A1* | 7/2011 | Adamson ..... | B41C 1/1041 101/453 |

FOREIGN PATENT DOCUMENTS

| | | | |
|---|---|---|---|
| EP | 1356926 | B1 | 1/2008 |
| EP | 2340169 | B1 | 5/2014 |
| GB | 2486673 | A | 6/2012 |
| JP | H03124385 | A | 5/1991 |
| JP | 2009513362 | A | 4/2009 |
| WO | 2007049064 | A1 | 5/2007 |
| WO | 2010029341 | A2 | 3/2010 |
| WO | 2011114169 | A2 | 9/2011 |

OTHER PUBLICATIONS

Search Report & Written Opinion for Corresponding International Application No. PCT/GB2016/051530 dated Sep. 12, 2016, 15 pages.

JP Office Action and English Summary thereof for JP Patent Application No. 2018-513921 dated Mar. 31, 2020, 8 pages.

* cited by examiner

METHODS OF ROUGHENING A SURFACE OF A PRINTING FORM PRECURSOR AND PRINTING USING A ROUGHENED PRINTING FORM PRECURSOR

FIELD

The present invention relates to improvements in the preparation of printing forms and printing form precursors, specifically for use in lithographic printing, using energy in the form of pulses of electromagnetic radiation. In particular the invention relates to methods of roughening a surface of a printing form precursor and/or methods of providing a printing form comprising an image formed of hydrophobic areas and hydrophilic areas. The invention also relates to printing form precursors having either a uniformly hydrophobic roughened surface or a uniformly hydrophilic roughened surface. The invention also relates to imaging devices or apparatus for carrying out the methods and/or producing the printing form precursors.

BACKGROUND

Fundamentally, all lithographic printing processes take a printing form precursor having a specially prepared surface which is uniform throughout and modifies selected regions of it, leaving reciprocal regions unmodified.

In many such processes the printing form precursor comprises a photosensitive coating, selected regions of which are modified and then subjected to a chemical developer. The chemical developer acts upon either the modified or unmodified regions to produce the differentiation needed for printing, for example a differentiation in the acceptance of an oleophilic ink component of a ink/water fountain solution. Optionally the developed surface is treated to harden the remaining areas of the coating, for example by baking, prior to printing.

It should be noted that in this specification we use the term 'printing form precursor' to denote the initial article having a surface undifferentiated in its acceptance or rejection of ink; and 'printing form' to denote the subsequently produced article having a differentiated surface which can be printed from. The term printing form herein may be substituted by the term printing plate. The term printing form is preferred in describing and defining the invention because it is of broad connotation. The term printing plate or just plate may nevertheless be used herein for ease of reading.

The present inventors have previously shown that a printing form precursor can be prepared for printing by applying energy in the form of pulses of electromagnetic radiation having a pulse length of not greater than $1\times10^{-6}$ seconds, in an imagewise manner, to an imageable surface of the printing form precursor, as described in WO 2010/029341, which may avoid the use of chemical developers.

The present inventors have also previously demonstrated a printing form precursor having a hydrophobic anodised metal oxide printing surface (or "anodic layer") with a weight of at least 3.5 $gm^{-2}$ which is capable of being made hydrophilic by energy in the form of pulses of electromagnetic radiation having a pulse length of not greater than $1\times10^{-6}$ seconds, as described in WO 2011/114169.

The surface of the printing form precursor used in the above methods may advantageously be roughened ("roughened" may be alternatively referred to as "grained") prior to carrying out the imaging method, to develop the topography of the printing surface and to render the surface more suitable for imaging and/or printing.

Roughness of a surface may be quantified by the value Ra. Ra can be measured using different techniques which give different values. For example, Ra can be measured by profilometry using a stylus traversing over a given distance on an apparatus such as a Mitutoyo SJ-210. An alternative technique involves using light interference microscopy which provides much higher levels of Z-axis resolution. The Ra value obtained by light interference microscopy is approximately twice that obtained by profilometry.

It has been suggested that having a fine roughness (Ra less than 0.45 as measured by profilometry) leads to a longer press life (see EP 1,356,926 and US 2003/200,886)

Known methods of roughening the surface of a printing form precursor include chemical treatment with a solution, such as mineral acid; electrochemical roughening using a hydrochloric acid electrolyte; and mechanical roughening using a slurry brush, for example.

Roughening processes may involve multiple steps using one or more of the known methods mentioned above, which may also include stages of polishing, in order to obtain a roughened surface of sufficient quality for subsequent imaging and printing processes.

Such known methods and processes may involve complicated and therefore costly and inefficient procedures and also may involve the use of expensive and potentially harmful chemicals.

SUMMARY OF THE INVENTION

It is one aim of example embodiments of the present invention, amongst others, to provide a method of roughening and/or a method of providing a printing form comprising an image and/or a printing form precursor and/or a device or apparatus for carrying out the methods which address at least one disadvantage of the prior art, whether identified here or elsewhere, or to provide an alternative to existing methods, printing form precursors or devices. For instance it is an aim of example embodiments of the present invention to provide a method of roughening which can selectively provide either a uniformly hydrophobic roughened surface or a uniformly hydrophilic roughened surface and which avoids the use of chemicals and complicated process steps.

It is also an aim of alternative example embodiments of the present invention to provide a method of producing a printing form having an image from a printing form precursor, the image formed of hydrophobic and hydrophilic regions, which avoids the use of chemicals and complicated process steps and may be produced directly by a single imaging device onto an untreated surface.

According to example embodiments, there is provided a method, a printing form precursor, a device and an apparatus, method and use as set forth in the appended claims. Other features of the invention will be apparent from the dependent claims, and the description which follows.

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention. Typically, when referring to compositions, a composition consisting essentially of a set of components will comprise less than 5% by weight, typically less than 3% by weight, more typically less than 1% by weight of non-specified components.

The term "consisting of" or "consists of" means including the components specified but excluding addition of other components.

Whenever appropriate, depending upon the context, the use of the term "comprises" or "comprising" may also be taken to encompass or include the meaning "consists essentially of" or "consisting essentially of", and may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also to be read as applicable to any other aspects or exemplary embodiments of the invention, where appropriate. In other words, the skilled person reading this specification should consider the optional features for each exemplary embodiment of the invention as interchangeable and combinable between different exemplary embodiments.

Method of Roughening

According to the first aspect of the present invention there is provided a method of roughening a surface of a printing form precursor, the method comprising subjecting at least a part of the surface to energy in the form of pulses of electromagnetic radiation to produce a uniformly hydrophilic roughened surface on at least a part of the printing form precursor and optionally converting the uniformly hydrophilic roughened surface of the printing form precursor to a uniformly hydrophobic roughened surface.

Suitably the part of the surface of the printing form precursor subjected to the energy corresponds to the area of the printing form precursor intended to be used for subsequent imaging and printing. Suitably substantially the entire surface of the printing form precursor is subjected to the energy. Suitably the entire surface of the printing form precursor is subjected to the energy.

The inventors have found that either a uniformly hydrophobic roughened surface or a uniformly hydrophilic roughened surface can be achieved in the method of this first aspect using pulses of electromagnetic radiation and the optional conversion step. Immediately after subjecting the surface to the energy in the method of this first aspect, the surface is hydrophilic, suitably superhydrophilic. In embodiments wherein a uniformly hydrophobic roughened surface is desired, the method involves a step of converting the uniformly hydrophilic roughened surface of the printing form precursor to a uniformly hydrophobic roughened surface. This conversion step may involve leaving the surface of the printing form precursor for a period of time after subjecting the surface to the energy in order for the uniformly hydrophilic roughened surface to convert to a uniformly hydrophobic roughened surface. This step of leaving the surface of the printing form precursor for a period of time after subjecting the surface to the energy may involve heating the printing form precursor.

For example, if a uniformly hydrophobic roughened surface is desired the surface of the printing form precursor may be subjected to pulses of electromagnetic radiation having a pulse energy of 0.34 mJ and a pulse length of $1.3\times10^{-7}$ s, to initially produce a uniformly hydrophilic roughened surface, and then left for 5 days at an ambient temperature of 30-40° C. to provide the uniformly hydrophobic roughened surface.

Alternatively, in other example embodiments, if a uniformly hydrophilic roughened surface is desired the surface of the printing form precursor may be subjected to pulses of electromagnetic radiation having a pulse energy of 0.42 mJ and a pulse length of $1\times10^{-7}$ s to immediately produce a uniformly hydrophilic roughened surface which remains hydrophilic when left for 5 days at an ambient temperature of 30-40° C., to provide the uniformly hydrophobic roughened surface.

Therefore, the method provides the advantage that either a uniformly hydrophobic roughened surface or a uniformly hydrophilic roughened surface can be selected by using the appropriate pulses of electromagnetic radiation and optionally including a step of leaving the surface of the printing form precursor for a period of time after subjecting the surface to the energy in order for the uniformly hydrophilic roughened surface to convert to a uniformly hydrophobic roughened surface.

By roughening we mean providing a plurality of surface details on the printing form precursor which alters the water contact angle of the surface. Roughness can be characterised by average roughness or fineness (Ra, typically measured in μm), mean maximum roughness depth (Rz, typically measured in μm) and surface area (typically measured in $mm^2$). Roughening may be alternatively referred to as graining.

The method may enable a uniformly hydrophobic roughened surface or uniformly hydrophilic roughened surface to be achieved with a single laser apparatus, using the optional conversion step and possibly different laser parameters. This may provide the advantage that the capital cost of the laser apparatus is reduced as only a single laser apparatus need be purchased to enable both uniformly hydrophobic roughened surfaces and uniformly hydrophilic roughened surfaces on printing form precursors to be produced.

Suitably the method does not comprise a step of chemical roughening.

Suitably the method does not comprise a step of electrochemical roughening.

Suitably the method does not comprise a step of mechanical roughening.

Suitably the method does not comprise any steps of chemical, electrochemical or mechanical roughening.

Suitably the method is a chemical-free method of roughening a surface of a printing form precursor. By chemical-free we mean that the method does not use chemical liquids or solutions, for example acidic or alkaline solutions. Suitably the surface of the printing form precursor is subjected to the energy in the form of pulses of electromagnetic radiation in the absence of a chemical treatment, for example in the absence of an acidic or alkaline solution. The method may involve the use of gases in a controlled atmosphere which is discussed in more detail below. By chemical-free we do not mean to exclude the use of gases in a controlled atmosphere.

The present invention provides a method of roughening a surface of a printing form precursor which is an alternative to known methods of mechanical, chemical or electrochemical roughening. The present method has several advantages over these known methods of roughening the surface of printing form precursors.

The uniformly hydrophobic roughened surface or uniformly hydrophilic roughened surface can be achieved without the use of potentially harmful chemicals such as sodium hydroxide, hydrochloric acid, sulphuric acid and/or phosphoric acid. Such chemicals are all normally used at elevated temperatures creating a toxic mist which must be scrubbed before venting to the atmosphere. Also, the interaction of these chemicals with aluminium printing form precursors creates hydrogen as a by-product which also creates an explosion risk which must be dealt with. These chemicals also require safe storage space. Furthermore chemical roughening processes may produce high volumes of waste acid and alkali solutions which must be treated before disposal.

The costs, inefficiencies and risks associated with handling with these chemicals and dealing with their waste products may be avoided by the present method.

Also, the costs associated with quality assurance of the chemicals used in the known methods of roughening are avoided.

Furthermore, the method may provide the advantage that quality control of the printing form precursor is easier to achieve than in a chemical roughening method, for example, as it is a more straightforward matter to change the parameters of the energy used in the method of this first aspect than to vary the chemical composition of a chemical roughening solution.

The method of the present invention may provide a more efficient process of printing form precursor and/or printing form preparation than known processes. Specifically, in known processes of printing form preparation, a production line of 200 m may be required. Approximately 150 m of such a production line may be taken up by the process for preparing the printing form precursor using known mechanical, chemical or electrochemical roughening methods. By using the method of roughening of the present invention, the length of the production line for preparing the printing form precursor may be reduced by a factor of ten. The footprint of the production line may therefore be significantly reduced, saving costs associated with factory space.

The Resultant Roughened Surface

The roughness of the uniformly hydrophobic roughened surface or uniformly hydrophilic roughened produced by the method of this first aspect can be characterised by several different parameters including average roughness (Ra, typically measured in μm), mean maximum roughness depth (Rz, typically measured in μm) and surface area (typically measured in $mm^2$). Methods of measuring these parameters are known in the art. In the following definitions the roughness values Ra and Rz are measured using light interference microscopy.

Suitably the method provides the surface of the printing form precursor with a uniform roughness having an Ra value, measured using light interference microscopy, of up to 12 μm, suitably up to 10 μm, for example up to 8 μm.

Suitably the method provides the surface of the printing form precursor with a uniform roughness having an Ra value, measured using light interference microscopy, of at least 0.2 μm, suitably at least 0.4 μm, for example at least 0.6 μm.

Suitably the method provides the surface of the printing form precursor with a uniform roughness having an Ra value, measured using light interference microscopy, of from 0.15 to 12 μm, suitably from 0.15 to 7 μm, for example from 0.2 to 7 μm.

Suitably the method provides the surface of the printing form precursor with a uniform roughness having an Rz value, measured using light interference microscopy, of from 2.0 to 120 μm, suitably from 2.0 to 100 μm, for example from 2.0 to 80 μm.

Suitably the method provides the surface of the printing form precursor with a uniform roughness with an increased surface area compared to the surface area of the surface of the printing form precursor before it is subjected to the energy.

The hydrophobicity or hydrophilicity of the surface produced by the method can be characterised by measuring the contact angle of water on the surface. Methods of measuring such a water contact angle are known in the art.

Suitably the method provides the surface of the printing form precursor with a uniformly hydrophobic roughened surface having a water contact angle of from 90 to 180°, suitably from 100 to 180°, for example from 120 to 180°.

In some embodiments, the method provides the surface of the printing form precursor with a uniformly hydrophobic roughened surface which is superhydrophobic. A superhydrophobic surface has water contact angle of 150° or greater.

Suitably the method provides the surface of the printing form precursor with a uniformly hydrophilic roughened surface having a water contact angle of from 0 to 89° , suitably from 0 to 40°, for example from 0 to 20°.

In some embodiments, the method provides the surface of the printing form precursor with a uniformly hydrophilic roughened surface which is superhydrophilic. A superhydrophilic surface has water contact angle of less than 10°.

The inventors have found that the method of this first aspect produces a surface on the printing form precursor which has an extremely random multi-directional structure, in other words a pattern-free topography, which is believed to be advantageous for subsequent imaging and printing processes. This structure is believed to be advantageous for subsequent imaging and printing steps, for example when the printing form precursor is imaged with a laser producing ordered arrangements of dots in order to carry out, for example, four colour printing. The random multi-directional structure may avoid the visual clashes and/or Moiré patterning caused by the orientation of dots which make up the image in such an imaging and printing process. The random multi-directional structure may assist with orientating the dots at different angles to avoid the visual clashes and/or Moiré patterning.

The inventors have found that by using the method of this first aspect a specific Ra value and water contact angle of the surface can be achieved by selecting a specific energy in the form of pulses of electromagnetic radiation, for example by selecting a specific pulse length and/or fluence of the pulses of electromagnetic radiation, and by selecting the optional conversion step. This means the method has the flexibility required to produce a wide range of roughened printing form precursor surfaces for use in different imaging and printing processes.

The inventors have found that there may be no relationship between the fineness (Ra) of the roughened surface produced and the final water contact angle which the surface eventually achieves. There may be a correlation between the fineness (Ra) of the roughened surface and the rate at which a maximum water contact angle is achieved by the surface.

The Surface of the Printing Form Precursor

Suitably the surface of the printing form precursor comprises aluminium and/or aluminium oxide. Suitably the surface substantially comprises aluminium oxide. Suitably the surface consists essentially of aluminium oxide.

Suitably the printing form precursor is an aluminium sheet, suitably with an aluminium oxide surface. Suitably the printing form precursor is a recycled printing form. Any surface coating features may have been removed from the recycled printing form. By "recycled printing form" we mean a printing form which has been previously used in a method of printing and comprises a surface which has already been roughened and/or imaged. Suitably the surface of the recycled printing form comprising a surface which has already been roughened and/or imaged is the surface on which the method of this first aspect is carried out. The printing form precursor may be a recycled aluminium printing form.

Alternatively, the printing form precursor may be a recycled aluminium sheet, for example an aluminium sheet produced using aluminium recycled from previous other uses such as in canning.

The method may employ aluminium sheet not previously used as a printing form or printing form precursor, suitably low grade aluminium sheets having a purity of below 99 wt %.

The inventors have found that the method of the present invention can provide a printing form precursor having a uniformly hydrophobic roughened surface or a uniformly hydrophilic roughened surface which is of an acceptable quality for subsequent imaging and printing processes, even when using a low grade aluminium sheet, for example an aluminium sheet produced using aluminium recycled from previous other uses such as in canning. Using such sheets in known methods of roughening may not provide a roughened surface of a suitable quality for subsequent imaging and printing. In known methods of printing form precursor and/or printing form preparation, it is necessary to use aluminium which is >99.5 wt % pure and therefore recycled aluminium cannot be used and still obtain an acceptable quality of printing form or printing form precursor. Such high purity is required because trace elements such as manganese and copper respond poorly to electrochemical processes and create an unacceptable or variable product. This type of pure aluminium is expensive relative to recycled aluminium which can be produced for a fifth of the cost of pure aluminium. Therefore the present method may provide a significant reduction in raw material cost.

Alternatively the surface of the printing form precursor may be steel, chrome plated steel, titanium, zirconium, zinc, copper or magnesium. The printing form precursor may be a steel, chrome plated steel, titanium, zirconium, zinc, copper or magnesium sheet.

Before the method is carried out, the surface of the printing form precursor may have a water contact angle in the range of from 50 to 100°.

Suitably the surface of the printing form precursor is uncoated by a developable image layer.

By uncoated by a developable image layer we mean that the surface of the printing form precursor does not carry a layer which is developable imagewise, in a developer liquid. Such a layer typically comprises an organic material, such as a film-forming polymer. It may be said that the surface of the printing form precursor has no potential for providing energy-induced solubility differential in a developer liquid.

Suitably the surface of the printing form precursor is unanodised before the method of this first aspect is carried out.

In alternative embodiments, the printing form precursor may be anodised. The printing form precursor may have an anodised metal oxide printing surface, the printing surface being hydrophobic. The metal oxide printing surface may have a weight of at least 1 $gm^{-2}$. In some embodiments the metal oxide printing surface may have a weight of at least 3.5 $gm^{-2}$, suitably at least 5.5 $gm^{-2}$, for example at least 6.5 $gm^{-2}$ or at least 8 $gm^{-2}$.

Suitably the metal oxide printing surface has a weight of up to 20 $gm^{-2}$.

The anodised printing form precursor may be coloured.

Suitable methods of colouring an anodised printing form are described in WO 2011/114169.

The advantages of using a coloured anodised printing form precursor are as described in WO 2011/114169.

The inventors have found that the method of this first aspect can be carried out on an anodised printing form or a raw metal or a polished metal printing form precursor to produce similar results. That is, the outcome of the method may not be significantly dependent on the nature and/or quality of the surface subjected to the energy. The anodised printing form may be a pre-used or recycled printing form or basic metal sheet used for other purposes such as canning.

The surface of the printing form precursor may be polished before the roughening is carried out. Polishing may be used to provide a surface of a printing form precursor having a variable cleanliness and/or roughness with a uniform cleanliness and/or roughness. Non-uniformity can arise from various metal faults, such as inclusions, rolled-in dirt and extreme rolling lines—the stress lines generated from cold rolling.

The surface of the printing form precursor may be polished by electrochemical polishing. Methods of carrying out an electrochemical polishing step are known in the art. One such method of electrochemical polishing may involve the application of DC voltage to an acidic bath in which the printing form precursor, connected as the anode of the cell, is suspended. The exact conditions and electrolyte depend on the metal of the printing form precursor but may involve a phosphoric acid solution or an ethanolic solution of perchloric acid, in the acidic bath.

An electrochemically polished surface of the printing form precursor may have a roughness (fineness) of Ra<0.10 μm.

The surface of the printing form precursor may be polished by mechanical polishing. Methods of carrying out a mechanical polishing step are known in the art. One such method may involve the physical abrasion of the surface of the printing form precursor by a slurry of a hard abrasive, such as corundum, of known particle size. Such a method is free of aggressive chemicals but it is more difficult to produce a very uniform finish. The mechanically polished surface of the printing form precursor may have a roughness (fineness) of Ra<0.5 μm.

The surface of the printing form precursor may be polished by laser polishing. Laser polishing involves scanning the metal surface with a laser beam that has sufficient fluence and power to remove protrusions on the surface but insufficient fluence and power to cause roughening. Laser polishing may be chemical-free and can produce a surface roughness of Ra=0.20-0.35 μm, suitably Ra=0.30-0.35. Typically a nanosecond laser would be employed for this purpose and operated at lower fluence than roughening for the same pulse length. For example, laser polishing may be carried out using pulses of electromagnetic energy having Two a pulse energy of 1.03 mJ and a pulse length of 420 ns using a laser spot size of 50 μm and a scan rate of N=#=3.

A metal sheet used to prepare a printing form precursor or a printing form may be supplied with a thin layer of oil on the surface. In known methods of preparing printing form precursors and/or printing forms, this layer of oil is removed using hot sodium hydroxide. As well as creating a uniform surface for subsequent roughening, both mechanical and laser polishing also may carry out the process of cleaning the surface, for example removing the oil.

In preferred embodiments the surface of the printing form precursor is not polished. The surface of the printing form precursor being unpolished has the advantage that the reflectivity of the surface is not increased by polishing. Increased reflectivity of the surface leads to a less efficient use of the incident the electromagnetic radiation in the method of this first aspect to produce the uniformly roughened surface.

The inventors have found that the method of this first aspect produces a uniformly hydrophobic roughened surface or a uniformly hydrophilic roughened surface which is of an acceptable quality for subsequent imaging and printing processes, whether or not the surface is a raw metal surface or an electrochemically polished surface. By raw metal we mean that the surface has not undergone any post manufacture surface treatments such as polishing, anodising, coating or graining/roughening. The characteristics of the uniformly hydrophobic roughened surface or the uniformly hydrophilic roughened surface produced by the method of this first aspect may not depend on the characteristics of the surface of a printing form precursor subjected to the energy.

The Pulses of Electromagnetic Radiation Used for Roughening

Suitably the pulses of electromagnetic radiation used in the method of this first aspect to produce either the uniformly hydrophilic roughened surface or, after optional conversion, the uniformly hydrophobic roughened surface on the printing form precursor, have a pulse length of at least $1\times10^{-15}$ s, suitably at least $1\times10^{-14}$ s, for example at least $1\times10^{-13}$ s, suitably at least $1\times10^{-12}$ s, at least $1\times10^{-11}$ s, at least $1\times10^{-10}$ s or at least $1\times10^{-9}$ s, suitably at least $1\times10^{-8}$ s.

Suitably the pulses of electromagnetic radiation have a pulse length of up to $1\times10^{-6}$ s, suitably up to $5\times10^{-7}$ s, for example up to $2.5\times10^{-7}$ s.

Suitably the pulses of electromagnetic radiation have a pulse length of from $1\times10^{-15}$ s to $1\times10^{-6}$ s, suitably from $1\times10^{-12}$ s to $1\times10^{-6}$ s, for example from $1\times10^{-10}$ s to $1\times10^{-6}$ s, suitably from $1\times10^{-9}$ s to $1\times10^{-6}$ s or from $1\times10^{-8}$ s to $5\times10^{-7}$ s.

Thus, suitably the method employs, to provide the energy in the form of pulse of electromagnetic energy, nanosecond, picosecond or femtosecond lasers. Such lasers provide pulses of high intensity; they are not adapted or gated CW lasers. Suitably the method employs, as the imaging device, a nanosecond and/or a picosecond laser fitted with a device, such as a Q-switch, to release intense pulses of laser energy "stored" during dwell times (in which the laser was still pumped but not releasing the photon energy produced).

One type of laser suitable for use in the present invention is a femtosecond laser, for example a laser capable of emitting pulses of pulse length in the range 30-1,000 femtoseconds (fs), suitably 50-400 fs, for example 100-250 fs.

Another type of laser preferred for use in the present invention is a picosecond laser, for example a laser capable of emitting pulses of pulse length in the range 1-200 picoseconds (ps), for example 5-100 ps. Suitably the picosecond laser is capable of emitting pulses having a pulse length of 80 ps.

Suitably the pulses of electromagnetic radiation have a pulse energy of at least 0.001 mJ, suitably at least 0.005 mJ, for example at least 0.0075 mJ, suitably at least 0.010 mJ.

Suitably the pulses of electromagnetic radiation have a pulse energy of up to 500 mJ, suitably up to 100 mJ, for example up to 50 mJ, suitably up to 10 mJ.

Suitably the pulses of electromagnetic radiation have a pulse energy of up to 2.0 mJ, suitably up to 1.5 mJ, for example up to 1.0 mJ, suitably up to 0.75 mJ.

Suitably the pulses of electromagnetic radiation have a pulse energy of from 0.001 mJ to 500 mJ, for example from 0.001 mJ to 100 mJ.

Suitably the pulses of electromagnetic radiation have a pulse energy of from 0.001 mJ to 2.0 mJ, suitably from 0.005 mJ to 1.5 mJ, for example from 0.0075 mJ to 1.0 mJ, suitably from 0.0075 mJ to 0.75 mJ.

Suitably the pulses of electromagnetic radiation have a pulse length in the range of $1\times10^{-11}$ s to $1\times10^{-6}$ s and a pulse energy in the range of 0.05 mJ to 2.0 mJ, suitably a pulse length in the range of $1\times10^{-9}$ s to $1\times10^{-6}$ s and a pulse energy in the range of 0.05 mJ to 1.0 mJ.

Suitably the pulses of electromagnetic radiation have a pulse length in the range of $1\times10^{-11}$ s to $1\times10^{-8}$ s and a pulse energy in the range of 0.001 mJ to 0.5 mJ, suitably a pulse length in the range of $1\times10^{-10}$ s to $5\times10^{-9}$ s and a pulse energy in the range of 0.005 mJ to 0.2 mJ.

Suitably the pulses of electromagnetic radiation have a pulse length in the range of $1\times10^{-15}$ s to $1\times10^{-12}$ s and a pulse energy in the range of 0.001 mJ to 0.1 mJ, suitably a pulse length in the range of $1\times10^{-14}$ s to $5\times10^{-13}$ s and a pulse energy in the range of 0.001 mJ to 0.01 mJ.

This invention uses pulsed radiation. Regarding energy density, the simplest analysis is when each pulse of electromagnetic radiation exposes a unique and previously unexposed spot on the surface. Furthermore if the beam is stationary at the arrival and throughout the duration of the pulse, then the energy density can be simply calculated. The beam power during the pulse can be estimated as the pulse energy, E (J), divided by the pulse length (s). The Power density is defined as this power divided by the spot area. However the exposure time is now solely the length of the pulse (s) and so the energy density becomes simply the pulse energy divided by the spot area, $E/D^2$. This energy density is commonly referred to as "Fluence" in the literature.

Normally it is not desirable to stop the beam movement to deliver pulses as this introduces delays and does not optimise the throughput of the process. Thus the beam traverses the surface during the extent of the pulse, as discussed below in relation to overlap. This can be regarded as elongating the spot in the direction of beam travel by an extent given by multiplying the traverse speed v by the pulse length t, with the spot area now being defined as D(D+tv). The formula for fluence, F, becomes:

$$F=E/(D(D+tv)=E/D^2(1+tv/D)$$

If $tv/D<<1$ then the effect of traverse speed can be ignored. For a spot size of 20 μm travelling at 1 $ms^{-1}$ and a pulse length of 10 pS then $tv/D=5\times10^{-7}$ so the effect of travel speed on the fluence can be safely ignored.

Another factor is related to pulse overlap. In embodiments wherein the method is carried out by scanning across the surface of a printing form precursor a single laser beam set to produce the energy in the form of pulses of electromagnetic radiation, the pulses may overlap. If the speed (v) is sufficiently high for a given frequency then the individual pulses do not overlap on the surface of the material. In such a case, it is simple to show that $fD/v<1$, where f is the repetition frequency of the pulsed electromagnetic source. When the traverse speed is such that the pulses are not spatially separated then the effect of overlapping pulses on the material surface may have to be considered. It is common in the literature of short pulsed laser processing to refer to the effect of overlapping pulses as "incubation" and to measure the degree of incubation by estimating the number of overlapping pulses, N, as $N=fD/v$. N is sometimes referred to as the incubation number or incubation factor and does not need to be an integer. If N<1 there is no overlap of pulses. When N=1 the exposure spots of successive pulses are touching, and as N increases there is increasing overlap of spots. For low values of N, say N<5, there may be little influence on incubation. However at high values of N a process may be regarded as a "quasi CW" process, and the energy density may be better expressed in terms of "Specific Energy".

Suitably the pulses of electromagnetic radiation have a fluence of up to 200 J/cm$^2$, suitably up to 100 J/cm$^2$, for example up to 75 J/cm$^2$.

Suitably the pulses of electromagnetic radiation have a fluence of at least 0.1 J/cm$^2$, suitably at least 0.2 J/cm$^2$, for example at least 0.5 J/cm$^2$.

Suitably the pulses of electromagnetic radiation have a fluence in the range of from 0.1 J/cm$^2$ to 200 J/cm$^2$, suitably in the range of from 0.1 J/cm$^2$ to 100 J/cm$^2$, for example in the range of from 0.2 J/cm$^2$ to 75 J/cm$^2$.

Suitably the pulses of electromagnetic radiation have a frequency of up to 20,000 kHz, suitably up to 2,000 kHz, for example up to 1,000 kHz.

Suitably the pulses of electromagnetic radiation have a frequency of at least 1 kHz, suitably at least 10 kHz, for example at least 50 kHz.

Suitably the pulses of electromagnetic radiation have a frequency in the range of from 1 kHz to 20,000 kHz, suitably in the range of from 10 kHz to 1,000 kHz, for example in the range of from 50 kHz to 1,000 kHz.

The pulses of electromagnetic radiation used in the method of this first aspect may generate a spot or pixel of any shape, for example circular, oval and rectangular, including square. Rectangular is preferred, as being able to provide full imaging of desired regions, without overlapping and/or missed regions.

Suitably the pulsed radiation is applied to an area of less than 0.2 cm$^2$ (e.g. a 5 mm diameter circle), suitably less than $7.8\times10^{-3}$ cm$^2$ (e.g. an 1 mm diameter circle), for example less than $7.8\times10^{-6}$ cm$^2$ (e.g. a 0.1 mm diameter circle).

Suitably the pulsed radiation is applied to an area greater than $1\times10^{-7}$ cm$^2$ (e.g. a 3.5 μm diameter circle), suitably greater than $5\times10^{-7}$ cm$^2$ (e.g. a 8 μm diameter circle), for example greater than $1\times10^{-6}$ cm$^2$ (e.g. a 11 μm diameter circle).

The natural profile of a laser beam, by which is suitably meant the energy or intensity, is Gaussian. However other beam profiles are equally suitable to carry out the method of this first aspect, especially laser beams with a square or rectangular profile (i.e. energy or intensity across the laser beam). The cross-sectional profile of the laser beam may be circular, elliptical, square or rectangular and suitably the intensity of the laser beam energy (or "profile" of the laser beam) is substantially uniform across the whole area of the cross-section.

Suitably the pulses of electromagnetic radiation have a peak power of at least 50 MW/cm$^2$, suitably at least 100 MW/cm$^2$, for example at least 150 MW/cm$^2$.

Suitably the wavelength of the pulses of electromagnetic radiation is in the range of 150 to 1400 nm, suitably in the range of 300 to 1200 nm, for example in the range of 400 to 1100 nm. For example, the pulses of electromagnetic radiation may be delivered by a nanosecond or picosecond laser and have a wavelength of 1064 nm. The pulses of electromagnetic radiation may be delivered by a femtosecond laser and have a wavelength of 800 nm.

Suitably the characteristics of the energy, for example the pulse length, pulse energy and fluence of the energy, are selected to produce either a uniformly hydrophilic roughened surface or a uniformly hydrophobic roughened surface, after the optional conversion step, on the printing form precursor, with a desired roughness, for example a particular fineness (Ra). The inventors have found that the characteristics of the energy which produce the desired uniformly hydrophilic roughened surface or the uniformly hydrophobic roughened surface, after the optional conversion step, on the printing form precursor, varies according to the substrate used. In the Examples, a "matrix" of energies is shown, for example in Table 2, which have each been tested to determine the nature of the surface produced by said energies in the method. Such a matrix and the accompanying experimental procedure shows how the energy required to produce either a uniformly hydrophilic roughened surface or a uniformly hydrophobic roughened surface, after the optional conversion step, on the printing form precursor can be determined and therefore implemented for any suitable surface/printing form precursor.

In addition to focussed, single spot laser exposure for producing the requisite roughening as discussed above, the method of this first aspect may involve Direct Laser Interference Patterning (DLIP) using, for example, high power pulsed nanosecond diode pumped solid state (DPSS) lasers, to provide the energy for roughening the surface. To produce such a DLIP roughening, an array of a small number of nanosecond lasers may be used to set up the interference exposure pattern. Alternatively, a beam-splitting optical pathway for a single laser could be used to deliver a similar effect. A particular advantage of the DLIP roughening may be that it provides a more effective and faster exposure coverage than can a focussed single spot exposure, potentially improving the throughput of a printing form/printing form precursor production process whilst using relatively low cost nanosecond lasers.

Heat Deformation

The method may cause deformation of the surface after subjecting the surface to the energy, due to heating. Deformation may be more pronounced when printing form precursors with a thickness (gauge) of approximately 0.3 mm or below are used in the method. The method may involve the use of energy in the form of pulses of electromagnetic radiation having a pulse length of less than $20\times10^{-9}$ s. The inventors have found that deformation of the surface of the printing form precursor with a thickness of 0.3 mm or less is minimised or eliminated by using energy with a pulse length in this range even down to a thickness of 0.15 mm.

Suitably the printing form precursor has a thickness of up to 0.3 mm, suitably up to 0.15 mm.

Laser Scanning

The method of this first aspect may be carried out by scanning across the surface of a printing form precursor a single laser beam set to produce the energy in the form of pulses of electromagnetic radiation. The method may be carried out by scanning across the surface of a printing form precursor a plurality of laser beams set to produce the energy in the form of pulses of electromagnetic radiation and/or a single laser beam split into a plurality of laser beams.

Alternatively the energy in the form of pulses of electromagnetic radiation may be provided by an inference pattern of multiple laser beams which is scanned across the surface. Using such an interference pattern of multiple laser beams produces a two-dimensional arrangement of surface detail on the surface of the printing form precursor which may comprise peaks and troughs on the surface.

Alternatively the method may be carried out by providing the surface of the printing form precursor with a micro-lens array which is then scanned with a single laser beam across the surface.

Effect of Pulse Overlap

In embodiments wherein the method is carried out by scanning across the surface of a printing form precursor a single laser beam set to produce the energy in the form of pulses of electromagnetic radiation, the pulses may overlap. The overlap of the pulses may be in a fast scan direction and/or a slow scan direction. The fast scan and slow scan directions are perpendicular to each other. By fast scan direction we mean the direction of travel of the single laser beam across the surface which produces a scan line on the surface. By slow scan direction we mean the direction perpendicular to the fast scan direction in which the laser beam or sample is moved to then produce another scan line parallel to the previous scan line.

Overlap in the fast scan direction is given by the value N, sometimes referred to as the incubation number or incubation factor and which does not need to be an integer. As discussed above, if N<1 there is no overlap of pulses. When N=1 the exposure spots of successive pulses are touching, and as N increases there is increasing overlap of spots. For a given beam diameter, N is controlled by adjustment of scan speed relative to repetition rate of the pulses.

Overlap in the slow scan direction is given by the value #, sometimes referred to as Hatch. # is controlled by positioning of the next scan line for a static system or by the speed of the sample in a dynamic system.

Suitably when the method uses pulses of electromagnetic radiation having a pulse length in the range of from $0.1\times10^{-12}$ s to $100\times10^{-9}$ s, either N=1 and # >1 or # =1 and N>1. The inventors have found that the method involving such overlap in the fast scan and/or the slow scan direction, a random multi-directional structure is produced on the surface which is advantageous for the performance of the uniformly hydrophobic roughened surface or uniformly hydrophilic roughened surface in subsequent imaging and/or printing processes.

When the method uses pulses of electromagnetic radiation having a pulse length in the range of from $0.1\times10^{-12}$ s to $500\times10^{-9}$ s, using an overlap of N=1 and #=1 results in a uniformly hydrophilic roughened surface which takes significantly longer to convert to a uniformly hydrophobic roughened surface on heating than when using an overlap of N>1 and #>1. The water contact angle of the uniformly hydrophobic roughened surface produced is higher in the cases where the overlap is N>1 and #>1 compared to when N=1 and #=1.

In embodiments wherein N >2.5 and #>2.5, the surface of the printing form precursor, after being subjected to the energy, comprises a highly ordered array of approximately parallel valleys are produced. These are examples of Laser Induced Plasma Structures (LIPS). On standing in ambient conditions for 3 months or preferably heating for 2 hours at 100° C., these surfaces become superhydrophobic. Effect of Time and Heating As discussed above, immediately after subjecting the surface to the energy in the method of this first aspect, the surface is hydrophilic, suitably superhydrophilic. Also as discussed above, in embodiments wherein a uniformly hydrophobic roughened surface is desired, the method involves a step of converting the uniformly hydrophilic roughened surface of the printing form precursor to a uniformly hydrophobic roughened surface.

In embodiments wherein a uniformly hydrophobic roughened surface is desired, the method involves a step of converting the uniformly hydrophilic roughened surface of the printing form precursor to a uniformly hydrophobic roughened surface. This conversion step may involve leaving the surface of the printing form precursor for a period of time after subjecting the surface to the energy in order for the uniformly hydrophilic roughened surface to convert to a uniformly hydrophobic roughened surface. This step of leaving the surface of the printing form precursor for a period of time after subjecting the surface to the energy may involve heating the printing form precursor.

For example, after subjecting the surface to certain energies, the roughened surface will only achieve a desired uniform hydrophobicity after a certain period of time, for example 2-3 days at an ambient temperature of from 30-40° C. It is not known by what mechanism the surface converts from hydrophilic to hydrophobic in this way. One hypothesis is that there is an intimate mixture formed on the surface after subjecting it to the energy, the intimate mixture comprising freshly revealed and reactive aluminium particles, alumina, Boehmite and Gibbsite. Over time, this intimate mixture may catalyse the reaction between aluminium and water which produces further alumina and so changes the water contact angle of the surface.

The method of this first aspect, in particular the optional conversion step, may be carried out under ambient conditions of temperature and atmosphere. However, the inventors have found that the temperature at which the method is carried out affects the time after the surface is subjected to the energy which is necessary to allow the surface to achieve uniform hydrophobicity, if desired, in the optional conversion step. For example, at a temperature of 30-40° C. the surface may take 2-3 days to achieve a desired uniform hydrophobicity after subjecting the surface to certain energies in the form of pulses of electromagnetic radiation. At a temperature of 15-25° C. the same surface may take 8-10 days to achieve a desired uniform hydrophobicity. At a temperature of 0-10° C. the same surface may take 3 weeks to achieve a desired uniformly hydrophobicity. The time necessary to achieve a desired uniform hydrophobicity is also affected by the energy in the form of pulses of electromagnetic radiation to which the surface is exposed. The same surface discussed above which may take only 2-3 days to achieve a desired uniform hydrophobicity after subjecting the surface to certain energies, may take weeks to achieve the desired uniform hydrophobicity after subjecting the surface to certain different energies.

The optional conversion step may be carried out at a temperature of 30-40° C., alternatively at a temperature of 15-25° C. or at a temperature of 0-10° C., each of which may be the ambient temperature.

Suitably the step of converting the uniformly hydrophilic roughened surface of the printing form precursor to a uniformly hydrophobic roughened surface involves leaving the printing form precursor under ambient conditions for at least 15 minutes, suitably at least 1 hour, for example at least 1 day.

Suitably the step of converting the uniformly hydrophilic roughened surface of the printing form precursor to a uniformly hydrophobic roughened surface involves leaving the printing form precursor under ambient conditions for up to 3 weeks, suitably up to 1 week, for example up to 3 days.

In embodiments wherein the method comprises a step of converting the uniformly hydrophilic roughened surface of the printing form precursor to a uniformly hydrophobic roughened surface, the step of converting may involve heating the surface after subjecting the surface to the energy. Heating the surface after subjecting the surface to the energy may decrease the time necessary for the surface to achieve a desired uniform hydrophobicity. The step of heating the surface after subjecting the surface to the energy may involve heating the printing form precursor to a temperature of least 30° C., suitably at least 40° C., suitably at least 60° C., for example at least 80° C.

The step of heating the surface after subjecting the surface to the energy may involve heating the printing form precursor to a temperature of up to 200° C., suitably up to 150° C., for example up to 120° C.

The step of heating the surface after subjecting the surface to the energy may involve heating the printing form precursor to a temperature in the range of 30 to 150° C., suitably in the range of 40 to 150° C.

In some embodiments the heating step can reduce the time necessary for the surface to achieve the desired uniform hydrophobicity from several days to several hours. Reducing this time increases the efficiency of the method and also the efficiency of an overall process of producing a printing form using the method.

In some embodiments the heating step can also increase the water contact angle of the surface compared to the water contact angle which would be achieved by leaving the printing form precursor for a longer period of time under ambient conditions. This increase in water contact angle may improve the quality of the printing form precursor and improve its performance in a subsequent printing process.

The method may involve a step of heating at a specific temperature and for a specific time which is selected to produce a particular water contact angle on the surface in the range of 100 to 180°. In this way the water contact angle of the roughened surface of the printing form precursor can be selected or tuned by an appropriate choice of the heating parameters, as well as the parameters of the energy, to provide a roughened surface with a particular water contact angle selected according to the intended use of the printing form precursor, for example to optimise a subsequent printing process using the printing form precursor. For example, in four colour printing, four printing forms are required and each printing form is placed on a separate printing unit, each printing unit provided with a source of water and coloured ink. Each coloured ink (black, cyan, magenta and yellow) have different wetting properties (surface energies) and each print unit has its own workable range of ink and water balance. A single printing form precursor used to make four different forms to be used on four different print units with four different inks cannot be an optimised process. This method of the first aspect may allow each printing form to be matched to the specific properties of the printing unit and specifically the coloured ink it is to be used with, to provide a more efficient, higher quality, optimised process.

Effect of Atmosphere

The method of this first aspect may be carried out in a controlled atmosphere. By controlled atmosphere we mean an atmosphere around the surface of the printing form precursor which has been artificially altered in pressure and/or gaseous content compared to ambient conditions.

In particular the surface of the printing form precursor may be subjected to the energy under a controlled atmosphere. The controlled atmosphere may be a vacuum. The controlled atmosphere may comprise a gaseous atmosphere enriched in a gas selected from any one or more of carbon dioxide, oxygen, nitrogen, water vapour, helium and argon. The controlled atmosphere may comprise may comprise bottled air.

By enriched we mean that the atmosphere substantially comprises the particular gas or gases with other gases possibly being present as impurities.

The inventors have found that the outcome of the method may depend on the atmosphere under which the surface is subjected to the energy. In particular the time necessary for the surface to achieve a desired uniform hydrophobicity after being subjected to the energy may be reduced by using a controlled atmosphere.

Suitably the surface of the printing form precursor may be subjected to the energy under an argon atmosphere. The inventors have found that time necessary for the surface to achieve a desired uniform hydrophobicity is reduced from several days to several hours, in some cases less than 15 minutes, after subjecting the surface to the energy.

Carrying out the method in a controlled atmosphere without heating may provide a hydrophobic surface, but may not provide a superhydrophobic surface. However, the method may be carried out in a controlled atmosphere with heating. In such embodiments the surface may achieve superhydrophobicity in less than 30 minutes.

Suitably the method of this first aspect is carried out in a controlled atmosphere of a reactive gas with subsequent heating, in the range of 40 to 150° C., for example 80 to 120° C., for example for at least 30 minutes. Suitable reactive gases may be selected from any one or more of bottled air, carbon dioxide or oxygen. The inventors have found that such a method produces a superhydrophobic surface.

Suitably the method of this first aspect is carried out in a controlled atmosphere of an inert gas. Suitable inert gases may be selected from any one or more of helium, argon and nitrogen.

The inventors have found that such a method produces a uniformly hydrophilic roughened surface which is more resistant to conversion to a uniformly hydrophobic roughened surface during a subsequent heating step than a surface provided by a method of the first aspect carried out in a controlled atmosphere of a reactive gas. This is important for establishing negative working imaging methods as will be described in relation to the fourth aspect.

Anodising

The method of this first aspect may involve a step of anodising the surface of the printing form precursor after subjecting the surface to the energy. If a step of heating the surface after subjecting the surface to the energy is present in the method, the step of anodising the surface may take place after the step of heat treatment. Alternatively, the step of anodising the surface may take place before the step of heat treatment. Anodising the surface may improve the durability and scratch resistance of the surface during subsequent printing processes.

Suitable methods of anodising the surface are known in the art.

The step of anodising the surface may comprise forming a layer of porous anodised alumina (PAA) on the surface. The layer of PAA may have an average pore size of from 0.5 to 1 μm. Suitable methods of forming a layer of PAA on the surface are known in the art.

In embodiments wherein the method involves a step of anodising the surface of the printing form precursor after subjecting the surface to the energy, the step of anodising may be followed by a step of post-anodic treatment (PAT). A step of PAT may seal the anodised surface to prevent small chemicals, especially dyes, being incorporated into the anodic pores and causing staining. Furthermore the water wettability of the surface may be improved after a step of PAT.

Suitable PATs include treatments by poly(vinylphosphonic acid), inorganic phosphates and fluoride-containing materials such as sodium fluoride and potassium hexafluorozirconate.

Suitable methods of PAT are known in the art.

The step of anodising the surface may be a hard-anodising step which may provide a continuous, non-porous barrier layer of oxide on the surface of the printing form precursor. Suitable methods of hard-anodising are known in the art.

Laser Imaging After Roughening

The uniformly hydrophobic roughened surface or the uniformly hydrophilic roughened surface produced by the method of this first aspect may be subsequently subjected imagewise to energy in the form of pulses of electromagnetic radiation to produce a printing form. The energy and other conditions to which the surface is subjected to imagewise is selected to change the surface from hydrophobic to hydrophilic in the imaged areas or from hydrophilic to hydrophobic in the imaged areas, as appropriate.

For example, a uniformly hydrophobic roughened surface produced by the method may be subjected imagewise to energy in the form of pulses of electromagnetic radiation to produce areas of hydrophilicity and provide a printing form. Such a printing form would be differentiated in its acceptance of oleophilic ink in that the areas of hydrophobic roughened surface which have not been subjected imagewise to the energy would be ink-accepting and the hydrophilic areas which have been subjected imagewise to the energy would be ink-repellent. The production of such a printing form is an example of "positive working".

For example, to use the method of this first aspect in a positive working imaging method, the surface of the printing form precursor may be subjected to a first energy in the form of pulses of electromagnetic energy having a pulse length of $13\times10^{-9}$ s and a pulse energy of 0.1 mJ to provide a uniformly hydrophilic roughened surface. This uniformly hydrophilic roughened surface may then be converted to a uniformly hydrophobic roughened surface by heating the printing form precursor to 100° C. for 2 hours. The uniformly hydrophobic roughened surface so produced may be superhydrophobic. This surface may then be subjected imagewise to a second energy in the form of pulses of electromagnetic radiation having a pulse length of $8\times10^{-11}$ s and a pulse energy of 8.5 μJ to produce areas of hydrophilicity and provide a printing form comprising an image for subsequent printing.

Alternatively, a uniformly hydrophilic roughened surface produced by the method may be subjected imagewise to energy in the form of pulses of electromagnetic radiation to produce areas of hydrophobicity, after a conversion step, and provide a printing form. Such a printing form would be differentiated in its acceptance of oleophilic ink in that the areas of hydrophilic roughened surface which have not been subjected imagewise to the energy would be ink-repellent and the hydrophobic areas which have been subjected imagewise to the energy would be ink-accepting. The production of such a printing form is an example of "negative working".

For example, to use the method of this first aspect in a negative working imaging method, the surface of the printing form precursor may be subjected to a first energy in the form of pulses of electromagnetic energy having a pulse length of $105\times10^{-9}$ s and a pulse energy of 0.34 mJ to provide a uniformly hydrophilic roughened surface. This uniformly hydrophilic roughened surface may then be subjected imagewise to a second energy in the form of pulses of electromagnetic radiation having a pulse length of $175\times10^{-9}$ s and a pulse energy of 0.56 mJ followed by a step of heating the printing form precursor to 100° C. for 1 hour to convert the areas subjected imagewise to the second energy from hydrophilic to hydrophobic, leaving the non-image areas hydrophilic as areas subjected to the first energy are slower to convert to hydrophobic than the areas exposed to the second energy, in this case.

The method of this first aspect may have the advantage that a printing form produced in the manner described above has a water-wetting contrast between image and non-image areas of up to 180° of water contact angle. Known methods of preparing printing forms may provide a water-wetting contrast between image and non-image areas of between 80-100° of water contact angle. This greater contrast means the printing forms have a greater ink-water discrimination which may lead to an improved subsequent printing process.

The Printing Form Precursor

According to a second aspect of the present invention there is provided a printing form precursor having either a uniformly hydrophobic roughened surface or a uniformly hydrophilic roughened surface, the roughened surface produced by subjecting the surface to energy in the form of pulses of electromagnetic radiation.

The suitable features of the printing form precursor of this second aspect are as described above in relation to the first aspect.

Imaging Devices for Roughening

According to a third aspect of the present invention there is provided an imaging device for subjecting a surface of a printing form precursor to energy in the form of pulses of electromagnetic radiation having a pulse length not greater than $1\times10^{-6}$ seconds selected to produce a uniformly hydrophilic roughened surface on the printing form precursor.

Suitably the energy produces a uniformly hydrophilic roughened surface on the printing form precursor which may convert to a uniformly hydrophobic roughened surface as described in relation to the first aspect.

The imaging device may be adapted to deliver the energy in the form of pulses of electromagnetic radiation as described in relation to the first aspect.

The imaging device may comprise a laser for providing the energy, for example a femtosecond laser or a picosecond laser. Such lasers provide pulses of high intensity; they are not adapted or gated CW lasers. Alternatively the imaging device may be a nanosecond laser fitted with a device, such as a Q-switch, to release intense pulses of laser energy "stored" during dwell times (in which the laser was still pumped but not releasing the photon energy produced).

Preferably the imaging device, of whatever type, does not produce substantial heat at the surface subjected to the energy.

The imaging device may comprise an ultra-fast fibre laser in which a chemically treated ("doped") optical fibre forms a laser cavity. This optical fibre is "pumped" by laser diodes, and there are several proprietary technologies used to couple the pumped light from the laser diodes into the optical fibre. Such lasers have relatively few optical components and are inexpensive, efficient, compact and rugged. They are thus considered to be especially suitable for use in this invention. However other ultra-short pulse or ultra-fast lasers may be used.

Method of Roughening and Imaging

According to a fourth aspect of the present invention there is provided a method of providing a printing form comprising an image formed of hydrophobic regions and hydrophilic regions, the method comprising the steps of:

a) roughening a surface of a printing form precursor according to a method of the first aspect to provide a uniformly hydrophobic roughened surface or a uniformly hydrophilic roughened surface;

b) after step a), either subjecting at least a part of the uniformly hydrophobic roughened surface imagewise to a second energy in the form of pulses of electromagnetic radiation to produce at least one hydrophilic image region on the otherwise uniformly hydrophobic roughened surface; or subjecting at least a part of the uniformly hydrophilic roughened surface imagewise to a second energy in the form of pulses of electromagnetic radiation to produce at least one hydrophilic image region on the otherwise uniformly hydrophilic roughened surface and converting the hydrophilic image region to a hydrophobic image region; and thereby provide the printing form.

The suitable features of the step a) are as described above in relation to the first aspect.

Method of Roughening and Imaging-Positive Working

In some embodiments the method of this fourth aspect is positive working and step b) involves subjecting at least a part of a uniformly hydrophobic roughened surface imagewise to a second energy in the form of electromagnetic radiation to produce at least one hydrophilic region on the surface. In such embodiments, subjecting the surface imagewise to the second energy causes a change in the properties of the surface from hydrophobic (ink-accepting) to hydrophilic (ink-repelling), in the part or parts subjected to the second energy. The part or parts which are not exposed to the second energy remain hydrophobic after step b). The part or parts subjected to the second energy provide the non-image or negative (ink-repelling) part of the image in a subsequent printing process. The part or parts not subjected to the second energy provide the image or positive (ink-accepting) part of the image in a subsequent printing process. This method is therefore a form of positive working.

In such positive working embodiments, step b) involves reducing the water contact angle of the surface in the part or parts subjected to the second energy. Suitably the water contact angle of the surface in the part or parts subjected to the second energy is reduced from between 60 and 180° to less than 60°.

An example of such a positive working embodiment was given above in relation to the first aspect.

The second energy, used in the method of this fourth aspect to produce the image on the surface, may be in the form of pulses of electromagnetic radiation. The pulses of electromagnetic radiation may have a pulse length of from $1\times10^{-15}$ s to $1\times10^{-6}$ s, suitably from $1\times10^{-14}$ s to $1\times10^{-7}$ s, for example from $1\times10^{-13}$ s to $1\times10^{-8}$ s.

Suitably the pulses of electromagnetic radiation have a pulse energy of at least 0.0001 mJ, suitably at least 0.0005 mJ, for example at least 0.00075 mJ, suitably at least 0.0010 mJ.

Suitably the pulses of electromagnetic radiation have a pulse energy of up to 2.0 mJ, suitably up to 1.5 mJ, for example up to 1.0 mJ, suitably up to 0.75 mJ.

Suitably the pulses of electromagnetic radiation have a pulse energy of from 0.0001 mJ to 2.0 mJ, suitably from 0.0005 mJ to 1.5 mJ, for example from 0.00075 mJ to 1.0 mJ, suitably from 0.00075 mJ to 0.75 mJ.

Suitably the pulses of electromagnetic radiation have a fluence of up to 10,000 J/cm$^2$, suitably up to 7,500 J/cm$^2$, for example up to 6,000 J/cm$^2$.

Suitably the pulses of electromagnetic radiation have a fluence of at least 0.001 J/cm$^2$, suitably at least 0.002 J/cm$^2$, for example at least 0.005 J/cm$^2$.

Suitably the pulses of electromagnetic radiation have a fluence in the range of from 0.001 J/cm$^2$ to 10,000 J/cm$^2$, suitably in the range of from 0.005 J/cm$^2$ to 10,000 J/cm$^2$, for example in the range of from 0.005 J/cm$^2$ to 7,500 J/cm$^2$.

Suitably the pulses of electromagnetic radiation have a frequency of up to 100,000 kHz, suitably up to 75,000 kHz, for example up to 50,000 kHz.

Suitably the pulses of electromagnetic radiation have a frequency of up to 1000 kHz, suitably up to 750 kHz, for example up to 500 kHz.

Suitably the pulses of electromagnetic radiation have a frequency of at least 1 kHz, suitably at least 10 kHz, for example at least 50 kHz.

Suitably the pulses of electromagnetic radiation have a frequency in the range of from 1 kHz to 1000 kHz, suitably in the range of from 10 kHz to 1000 kHz, for example in the range of from 50 kHz to 750 kHz.

The pulses of electromagnetic radiation may generate a spot or pixel of any shape, for example circular, oval and rectangular, including square. Rectangular is preferred, as being able to provide full imaging of desired regions, without overlapping and/or missed regions.

Suitably the pulses of electromagnetic radiation are applied to an area of less than $1\times10^{-4}$ cm$^2$ (e.g. a 113 μm diameter circle), suitably less than $5\times10^{-5}$ cm$^2$ (e.g. a 80 μm diameter circle), for example less than $1\times10^{-5}$ cm$^2$ (e.g. a 35 μm diameter circle).

Suitably the pulses of electromagnetic radiation are applied to an area greater than $1\times10^{-3}$ cm$^2$ (e.g. a 3.5 μm diameter circle), suitably greater than $5\times10^{-7}$ cm$^2$ (e.g. a 8 μm diameter circle), for example greater than $1\times10^{-6}$ cm$^2$ (e.g. a 11 μm diameter circle).

In some embodiments, the pulsed radiation may be applied to an area of less than 0.2 cm$^2$ (e.g. a 5 mm diameter circle), suitably less than $7.8\times10^{-3}$ cm$^2$ (e.g. an 1 mm diameter circle), for example less than $7.8\times10^{-5}$ cm$^2$ (e.g. a 0.1 mm diameter circle).

Suitably the pulses of electromagnetic radiation are applied to a circular spot with a diameter of between 1 and 100 μm.

The pulse shape of the pulses of electromagnetic radiation used in the method of this fourth aspect to produce the image on the surface are as described in relation to the pulses of electromagnetic radiation used in the method of the first aspect to produce the roughened surface.

Suitably the pulses of electromagnetic radiation have a peak power of at least 50 MW/cm$^2$, suitably at least 100 MW/cm$^2$, for example at least 150 MW/cm$^2$.

Suitably the wavelength of the pulses of electromagnetic radiation is in the range of 150 to 1400 nm, suitably in the range of 300 to 1200 nm, for example in the range of 400 to 1100 nm. For example, the pulses of electromagnetic radiation may be delivered by a nanosecond or picosecond laser and have a wavelength of 1064 nm. The pulses of electromagnetic radiation may be delivered by a femtosecond laser and have a wavelength of 800 nm.

Alternatively, the second energy may be in the form of a quasi continuous wave of electromagnetic radiation. By quasi continuous wave of electromagnetic radiation we mean a pulses of electromagnetic radiation having high values of N and therefore a high overlap in the fast scan direction. The quasi continuous wave of electromagnetic radiation may have a dwell time on a specific pixel of from $1\times10^{-15}$ s to $1\times10^{-6}$ s, suitably from $1\times10^{-14}$ s to $1\times10^{-7}$ s, for example from $1\times10^{-13}$ s to $1\times10^{-8}$ s.

Method of Roughening and Imaging-Negative Working

In alternative embodiments, the method of this fourth aspect is negative working and step b) involves subjecting at least a part of the uniformly hydrophilic roughened surface imagewise to a second energy in the form of pulses of electromagnetic radiation to produce at least one hydrophilic image region on the otherwise uniformly hydrophilic roughened surface and converting the hydrophilic image region to a hydrophobic image region.

In such embodiments, subjecting the surface imagewise to the second energy and then converting the hydrophilic image region to a hydrophobic image region causes a change in the properties of the surface from hydrophilic (ink-repelling) to hydrophobic (ink accepting), in the part or parts subjected to the second energy. The part or parts which are not exposed to the second energy remain hydrophilic after step b). The part or parts subjected to the second energy provide the image or positive (ink-accepting) part of the image in a subsequent printing process. The part or parts not subjected to the second energy provide the non-image or negative (ink repelling) part of the image in a subsequent printing process. This method is therefore a form of negative working.

In such negative working embodiments, step b) involves increasing the water contact angle of the surface in the part or parts subjected to the second energy. Suitably the water contact angle of the surface in the part or parts subjected to the second energy is increased from less than 10° to greater than 60°.

An example of such a negative working embodiment was given above in relation to the first aspect.

The second energy may be in the form of pulses of electromagnetic radiation. The pulses of electromagnetic radiation may have a pulse length of from $1\times10^{-15}$ s to $1\times10^{-6}$ s, suitably from $1\times10^{-14}$ s to $1\times10^{-7}$ s, for example from $1\times10^{-13}$ s to $1\times10^{-8}$ s.

Such negative working embodiments have the advantage that only the image parts of the printing form intended to form a printed image in a subsequent printing process are subjected to the second energy. The image parts of the printing form are usually smaller in area than the non-image parts and so in such embodiments a smaller area of the printing form precursor has to be subjected to the second energy than in the positive working embodiments, providing a saving in process time and in the energy required in step b).

The pulse energy, fluence, frequency, spot size, pulse shape, peak power and wavelength of the second energy used to provide the image in these negative working embodiments may be as described above for the second energy used in the positive working embodiments.

Alternatively, the second energy may be in the form of a quasi continuous wave of electromagnetic radiation. By quasi continuous wave of electromagnetic radiation we mean a pulses of electromagnetic radiation having high values of N and therefore a high overlap in the fast scan direction. The quasi continuous wave of electromagnetic radiation may have a dwell time on a specific pixel of from $1\times10^{-15}$ s to $1\times10^{-6}$ s, suitably from $1\times10^{-14}$ s to $1\times10^{-7}$ s, for example from $1\times10^{-13}$ s to $1\times10^{-8}$ s.

In such negative working embodiments, the method may involve a step c) after step b), step c) comprising heating the surface at a temperature of from 30° C. to 200° C. for a period of from 1 minute to 1 day. Suitably step c) increases the water contact angle of the surface in the part or parts of the surface subjected to the second energy. Suitably after step c), the part or parts of the surface subjected to the second energy have a water contact angle of from 60° to 180° suitably from 80° to 180°, for example from 100° to 180°. Suitably after step c), the part or parts of the surface not subjected to the second energy have a water contact angle of less than 20°.

The method of this fourth aspect may involve using a single imaging device to deliver the energy required to carry out step a) and to deliver the second energy required to carry out step b).

The imaging device may have any of the suitable features of the imaging device of the third aspect.

The method of this fourth aspect may involve using a single laser within a single imaging device to deliver the energy required to carry out step a) and to deliver the second energy required to carry out step b).

The laser may have any of the suitable features of the laser referred to in relation to the third aspect.

Alternatively the method of this fourth aspect may involve using a single imaging device comprising a first laser to deliver the energy required to carry out step a) and a second laser to deliver the second energy required to carry out step b).

An alternative negative working embodiment of the method of this fourth aspect may involve in step a) roughening a surface of a printing form precursor according to a method of the first aspect in a controlled atmosphere of an inert gas, for example helium, argon or nitrogen, to provide a uniformly hydrophilic roughened surface; and in step b) subjecting at least a part of the uniformly hydrophilic roughened surface imagewise to a second energy in the form of pulses of electromagnetic radiation in a controlled atmosphere of a reactive gas, for example carbon dioxide, oxygen or bottled air, to produce at least one hydrophilic image region on the otherwise uniformly hydrophilic roughened surface and converting the hydrophilic image region to a hydrophobic image region by heating the surface, for example at a temperature of 30 to 150° C. for a period of 1 minute to 24 hours.

Method of Roughening and Imaging-Using Photosensitive Coatings

The method of this fourth aspect may involve, after step a) and before step b) a step of providing the surface with a photosensitive coating and a step after step b) of developing the photosensitive coating. Suitably the photosensitive coating is a photosensitive polymer. In embodiments wherein step a) involves roughening the surface of a printing form precursor according to the method of the first aspect to provide a uniformly hydrophilic roughened surface, the photosensitive coating may provide a uniformly hydrophobic surface. Suitable photosensitive coatings are capable of reacting to electromagnetic energy to produce either an increase or a decrease in the solubility of the coating in a developing solution.

The term "photosensitive coating" herein denotes the use of coating chemicals provided at the surface on the printing form precursor which are intended to respond to a certain wavelength of electromagnetic radiation, or to a narrow band of radiation, to produce a desired change on the surface. For example, the electromagnetic radiation may cause a chemical change, for example a chemical reaction, or a chemico-physical change, for example the forming or breaking of hydrogen bonds, to render the exposed regions of the coating more soluble, or less soluble, in a developing solution. The change normally requires a narrow Gaussian peak of electromagnetic radiation. The chemistry may be regarded as "tuned" to that wavelength or peak.

Suitable photosensitive coatings are known in the art.

In such embodiments, step b) involves subjecting at least a part of the uniformly hydrophobic photosensitive coating imagewise to a second energy in the form of pulses of electromagnetic radiation to produce the image on the surface. The part or parts of the photosensitive coating subjected to the second energy may be non-image parts of the coating and cause said part or parts to become more soluble in a developing solution so that the non-image part or parts are dissolved in the developing solution and removed from the printing form precursor to reveal the hydrophilic roughened surface and provide an image part formed of the remaining photosensitive coating. The printing form provided by this method may then be used in a printing process wherein the image areas of photosensitive coating are (oleophilic) ink-accepting and the non-image areas of exposed hydrophilic roughened surface are (oleophilic) ink-rejecting. This is an example of positive working.

Alternatively, the part or parts of the photosensitive coating subjected to the second energy may be image parts of the coating and cause said part or parts to become less soluble in a developing solution so that non-image parts of the coating are dissolved in the developing solution and removed from the printing form precursor to reveal the hydrophilic roughened surface and provide an image part formed of the remaining photosensitive coating. The printing form provided by this method may then be used in a printing process wherein the image areas of photosensitive coating are (oleophilic) ink-accepting and the non-image areas of exposed hydrophilic roughened surface are (oleophilic) ink-rejecting. This is an example of negative working.

The features of the second energy to which the photosensitive coating is subjected in such embodiments are known in the art.

Suitably the method involves using a single imaging device to deliver the energy required to carry out step a) of providing the roughened surface and to deliver the second energy required to carry out step b) of subjecting at least a part of the uniformly hydrophobic photosensitive coating imagewise to the second energy to produce the image on the surface.

Known methods using photosensitive coatings on printing form precursors may suffer from a lack of roughness uniformity of the surface of the printing form precursor which can make it difficult to remove coating from deeper parts of the roughened surface with a developing solution, leaving behind ink-receptive "blue spots". This means the coating has to be slightly more soluble than would otherwise be necessary. The method of this fourth aspect may overcome this problem by providing a uniformly hydrophilic roughened surface produced in step a) onto which the photosensitive coating is applied. Furthermore, the present method may allow the use of a photosensitive coating which is less soluble in a developing solution (more robust to an aggressive developing solution) and/or which requires less energy to either increase or decrease the solubility of the coating.

Method of Roughening and Imaging-Polishing

The method of this fourth aspect may involve a step of polishing the printing form precursor before step a). Suitable polishing methods are as described in relation to the first aspect. Suitably the step of polishing is a laser polishing step. Suitably the step of polishing is carried out by subjecting the printing form to a third energy in the form of pulses of electromagnetic energy. Suitably the method involves using a single imaging device to deliver the third energy required to carry out the polishing step, to deliver the energy required to carry out step a) of providing the roughened surface and to deliver the second energy required to carry out step b).

Suitably the method involves using a single laser to deliver the third energy required to carry out the polishing step, to deliver the energy required to carry out step a) of providing the roughened surface and to deliver the second energy required to carry out step b).

Suitably the method of this fourth aspect can be carried out on the suitable printing form precursors referred to in relation to the first aspect.

The method of this fourth aspect may involve using a recycled printing form or a sheet of metal not originally intended for imaging. In other words, the method may involve carrying out step a) on a printing form which has been previously used in a method of printing and comprises a roughened and/or an imaged surface. Such a printing form may be referred to as a recycled printing form. The recycled printing form may be a product of a first method according to this fourth aspect and the printing form may have been used in a method of printing after carrying out a first method according to this fourth aspect.

The inventors have found that the method of this fourth aspect has the benefit that it can be carried out using a recycled printing form as the printing form precursor. This reduces the cost of the materials involved in providing the printing form precursor and reduces the waste material produced by and environmental impact of the method and a subsequent printing process compared to known methods which must be carried out on new printing form precursors in order to produce the same quality of printing form and subsequent printing process.

The method of this fourth aspect may be repeated in the manner described above using recycled printing forms at least two times, suitably at least three times, for example at least four times.

The method of this fourth aspect may be repeated in the manner described above using recycled printing forms up to one hundred times, suitably up to twenty times, for example up to ten times.

Method of Roughening and Imaging-Cleaning

The method of this fourth aspect may involve a step of cleaning the printing form before step a) to remove any residual ink and other debris from a used printing form. Suitably the step of cleaning is a laser cleaning step. Suitably the step of cleaning is carried out by subjecting the printing form to a fourth energy in the form of pulses of electromagnetic energy. Suitably the method involves using a single imaging device to deliver the fourth energy required to carry out the cleaning step, to deliver the energy required to carry out step a) and to deliver the second energy required to carry out step b) and to deliver the third energy required to carry out the polishing step, if present.

Suitably the method involves using a single laser to deliver the fourth energy required to carry out the cleaning step, to deliver the energy required to carry out step a) and to deliver the second energy required to carry out step b) and to deliver the third energy required to carry out the polishing step, if present.

In alternative embodiments, the step of cleaning may be carried out by a different laser to that used for step a) and/or step b) and/or a the polishing step, if present.

The features of the fourth energy may be as described in relation to the energy used in the method of the first aspect to produce the uniformly hydrophilic roughened surface of the printing form precursor.

Suitably, in the method of this fourth aspect, step a) comprises subjecting at least a part of the surface to energy in the form of pulses of electromagnetic radiation having a pulse length of from $1\times10^{-15}$ s to $1\times10^{-6}$ s in a controlled atmosphere to produce a uniformly hydrophilic roughened surface on the printing form precursor and converting the uniformly hydrophilic roughened surface of the printing form precursor to a uniformly hydrophobic roughened surface by heating the surface to a temperature in the range of 40 to 150° C., after subjecting the surface to the energy; and step b) comprises subjecting at least a part of the uniformly hydrophobic roughened surface imagewise to a second energy in the form of pulses of electromagnetic radiation having a pulse length of from $1\times10^{-15}$ s to $1\times10^{-6}$ s to produce the at least one hydrophilic image region on the otherwise uniformly hydrophobic roughened surface.

Suitably in step a), after subjecting the surface to the energy, the surface is heated for at least 1 minute.

Method of Printing Using a Recycled Printing Form

According to a fifth aspect of the present invention there is provided a method of printing using a recycled printing form, the method comprising the steps of:

a) roughening a surface of a printing form precursor according to a method of the first aspect to provide a uniformly hydrophobic roughened surface or a uniformly hydrophilic roughened surface;

b) after step a), either subjecting at least a part of the uniformly hydrophobic roughened surface imagewise to a second energy in the form of pulses of electromagnetic radiation to produce at least one hydrophilic image region on the otherwise uniformly hydrophobic roughened surface; or subjecting at least a part of the uniformly hydrophilic roughened surface imagewise to a second energy in the form of pulses of electromagnetic radiation to produce at least one hydrophilic image region on the otherwise uniformly hydrophilic roughened surface and converting the hydrophilic image region to a hydrophobic image region; and thereby provide the printing form;

c) after step b), carrying out a method of printing using the printing form provided by step b);

d) after step c), repeating steps a) to c) at least once using the printing form used in step c).

The method of this fifth aspect may have any of the suitable features of the method of the fourth aspect.

Step d) may involve repeating steps a) to c) using the same printing form used in step c) more than once. Suitably step d) involves repeating steps a) to c) using the same printing form at least two times, suitably at least three times, for example at least four times.

Suitably step d) involves repeating steps a) to c) using the same printing form up to one hundred times, suitably up to twenty times, for example up to ten times.

The method of this fifth aspect may involve any of the suitable features referred to in relation to the methods of the first and fourth aspects.

The method of this fifth aspect may involve a step of polishing the printing form precursor before step a). Suitable polishing methods are as described in relation to the first aspect.

Suitably the step of polishing is a laser polishing step. Suitably the step of polishing is carried out by subjecting the printing form to a third energy in the form of pulses of electromagnetic energy.

The method of this fifth aspect may involve a step of cleaning the printing form after step c) and before step d) to remove any residual ink and other debris from the used printing form. Suitably the step of cleaning is carried out by a laser. Suitable laser cleaning methods are as described in relation to the first and fourth aspects.

Suitably the step of cleaning is carried out by subjecting the printing form to a fourth energy in the form of pulses of electromagnetic energy. The step of cleaning may be carried out by the same laser as is used for step a) and/or step b). In alternative embodiments, the step of cleaning may be carried out by a different laser to that used for step a) and/or step b).

The advantages of recycling the printing form in the manner of this method of the fifth aspect are as defined in relation to the fourth aspect.

Method of Printing Using a Recycled Printing Form-Apparatus

According to a sixth aspect of the present invention there is provided an apparatus for carrying out the method of the fourth aspect and/or the fifth aspect to produce a printing form, the apparatus comprising at least one laser adapted to deliver energy in the form of pulses of electromagnetic radiation having a pulse length not greater than $1\times10^{-6}$ seconds.

Suitably the at least one laser is adapted to deliver a first energy in order to carry out step a) of the fourth aspect and/or the fifth aspect to provide a uniformly hydrophobic roughened surface or a uniformly hydrophilic roughened surface. Suitably the at least one laser is adapted to deliver a second energy in order to carry out step b) of the fourth aspect and/or the fifth aspect to produce the image on the surface. Suitably the at least one laser delivers both the first and the second energies in order to carry out steps a) and b) of the fourth aspect and/or the fifth aspect.

In alternative embodiments, the at least one laser is adapted to deliver the first energy in order to carry out step a) of the fourth aspect and/or the fifth aspect and the apparatus comprises a second laser adapted to deliver the second energy in order to carry out step b) of the fourth aspect and/or the fifth aspect.

The at least one laser and the second laser, if present, may have any of the suitable features of the laser referred to in relation to the third, fourth and/or fifth aspects and may be adapted to deliver the energy in the form of pulses of electromagnetic radiation as described in relation to the first aspect.

The at least one laser may be adapted to deliver energy in the form of pulses of electromagnetic radiation having a pulse length in the range of $1\times10^{-11}$ s to $1\times10^{-8}$ s.

The apparatus may comprise a laser adapted to deliver a third energy in the form of pulses of electromagnetic radiation in order to carry out a laser polishing of the printing form precursor. Suitably the at least one laser is adapted to deliver the third energy in order to carry out a laser polishing of the printing form precursor.

The laser adapted to deliver a third energy may be the at least one laser. Alternatively the apparatus may comprise a second or third laser adapted to deliver the third energy in order to carry out the laser polishing of the printing form precursor.

The third energy may have a pulse length in the range of from $1.0\times10^{-8}$ s to $2.5\times10^{-7}$ s, a pulse energy in the range 0.1 mJ to 0.4 mJ and a fluence in the range of from 1 to 50 $J/cm^2$.

Whether an energy in the form of pulses of electromagnetic energy produces a roughening or a polishing effect on a surface of the printing form precursor, for a given surface, can be readily determined by visual inspection of the surface. The polishing producing a more reflective surface than the roughening.

The apparatus may comprise a laser adapted to deliver a fourth energy in the form of pulses of electromagnetic radiation in order to carry out a laser cleaning of the printing form precursor. Suitably the at least one laser is adapted to deliver the fourth energy in order to carry out a laser cleaning of the printing form precursor.

The laser adapted to deliver a fourth energy may be the at least one laser. Alternatively the apparatus may comprise a second, third or fourth laser adapted to deliver the fourth energy in order to carry out the laser cleaning of the printing form precursor.

The laser adapted to deliver a fourth energy in order to carry out a laser cleaning of the printing form precursor may allow a recycled printing form to be used in the method of the fourth and/or the fifth aspect. The advantages of using recycled printing forms are as described above in relation to the fourth aspect.

The apparatus may comprise a heater adapted to heat the printing form and/or a printing form precursor after step a) and/or step b) of the fourth aspect. Suitably the heater can provide the heating step as described in relation to the first and fourth aspects.

Suitably the apparatus is adapted to receive a printing form precursor, suitably a recycled printing form, and optionally carry out a step of laser cleaning, optionally carry out a step of laser polishing, carry out step a) of the fourth aspect and/or the fifth aspect and carry out step b) of the fourth aspect and/or the fifth aspect and produce a printing form ready for a printing process to be carried out.

The apparatus may comprise a manual or automatic loading device for loading the printing form precursor into the apparatus and accurately positioning the printing form precursor in order for the method of the fourth aspect and/or the fifth aspect to produce a printing form to be carried out.

The apparatus may comprise at least one gas bottle and/or means for providing a vacuum for applying a controlled atmosphere during the method of the fourth aspect and/or the fifth aspect.

Suitably the apparatus has a flat-bed type structure. In alternative embodiments the apparatus may have an internal drum type structure.

Method of Directly Imaging a Printing Form Precursor

According to a seventh aspect of the present invention, there is provided a method of producing a printing form having an image from a printing form precursor, the image formed of hydrophobic regions and hydrophilic regions, the method comprising the steps of:

a) subjecting at least a first part of a surface of the printing form precursor to a first energy in the form of pulses of electromagnetic radiation, in a method according to the first aspect, to provide the hydrophobic regions; and b) subjecting at least a second part of the surface of the printing form precursor to a second energy in the form of pulses of electromagnetic radiation, in a method according to the first aspect, to provide the hydrophilic regions.

The method of this seventh aspect may provide a direct imaging process whereby an image formed of hydrophobic and hydrophilic regions is applied to a surface of a printing form precursor in a single process, rather than being applied in more than one process according to known methods. Applying the image in a single process according to the method may therefore significantly reduce the time required to produce a printing form from a printing form precursor and/or reduce the cost of producing a such a printing form and/or reduce the energy required to produce such a printing form and/or reduce the waste material produced by such a process, compared to known methods.

The suitable features of the printing form precursor and the surface of the printing form precursor are as described in relation to the first aspect.

The first energy may have any of the features of the energy which produces the uniformly hydrophobic roughened surface, after the optional conversion step, as referred to in relation to the first aspect.

The second energy may have any of the features of the energy which produces the uniformly hydrophilic roughened surface referred to in relation to the first aspect.

The suitable features of the first and second energies are as described in relation to providing the hydrophobic and hydrophilic regions and/or surfaces of the first aspect.

The hydrophobic regions provided by the first energy may be roughened hydrophobic regions. The roughened hydrophobic regions may have any of the suitable features of the uniformly hydrophobic roughened surface referred to in relation to the first aspect.

The hydrophilic regions provided by the second energy may be roughened hydrophilic regions. The roughened hydrophilic regions may have any of the suitable features of the uniformly hydrophilic roughened surface referred to in relation to the first aspect.

Suitably the first Energy and the Second Energy are different.

Suitably the hydrophobic regions are only subjected to the first energy of step a) and not the second energy of step b).

Suitably the hydrophilic regions are only subjected to the second energy of step b) and not the first energy of step a).

Steps a) and b) may be carried out in either order.

In some embodiments, the method of this seventh aspect may involve in step a) subjecting all the parts of the surface of the printing form precursor which provide the hydrophobic regions of the image to the first energy and in step b) subjecting all the parts of the surface of the printing form precursor which provide the hydrophilic regions of the image to the second energy.

In alternative embodiments, the method may involve selectively subjecting the surface to either the first or the second energy as an imaging device scans the surface in order to provide the image. Such embodiments may involve selectively producing a succession of either hydrophobic or hydrophilic dots or pixels on the surface, said dots providing the image. The image may be provided in a single scan of the imaging device across the surface in a fast scan and a slow scan direction. Such embodiments may have the advantage that the image is produced more efficiently than in embodiments involving more than one scan of the imaging device across the surface.

In the method of this seventh aspect steps a) and b) may be carried out by a single imaging device. Suitably the single imaging device comprises a single laser adapted to selectively produce the first and second energies. Using a single imaging device and a single laser has the advantage of saving on capital costs for the equipment required to carry out the method as only a single imaging device or laser has to be provided.

In alternative embodiments steps a) and b) may be carried out using separate imaging devices or separate lasers within a single imaging device.

The first and second energies may be selected from and have any of the suitable features described in relation to the energy used in the method of the first aspect.

Method of Directly Imaging A Printing Form Precursor-Apparatus

According to an eighth aspect of the present invention there is provided an apparatus for carrying out the method of the seventh aspect, the apparatus comprising at least one imaging device comprising at least one laser adapted to deliver a first and/or a second energy in the form of pulses of electromagnetic radiation having a pulse length not greater than $1\times10^{-6}$ seconds.

Suitably the apparatus comprises a single imaging device. Suitably the single imaging device comprises a single laser adapted to selectively produce the first and second energies referred to in relation to the method of the seventh aspect.

In alternative embodiments the apparatus comprises separate imaging devices or separate lasers within a single imaging device adapted to selectively produce the first and second energies referred to in relation to the method of the seventh aspect.

The apparatus of this eighth aspect may have any of the features described in relation to the apparatus of the sixth aspect.

According to a ninth aspect of the present invention, there is provided a method, printing form, imaging device or apparatus substantially as described herein.

BRIEF DESCRIPTION OF THE DRAWINGS

In the following examples, reference is made to the Figures in which.

EXAMPLES

Figure 1:
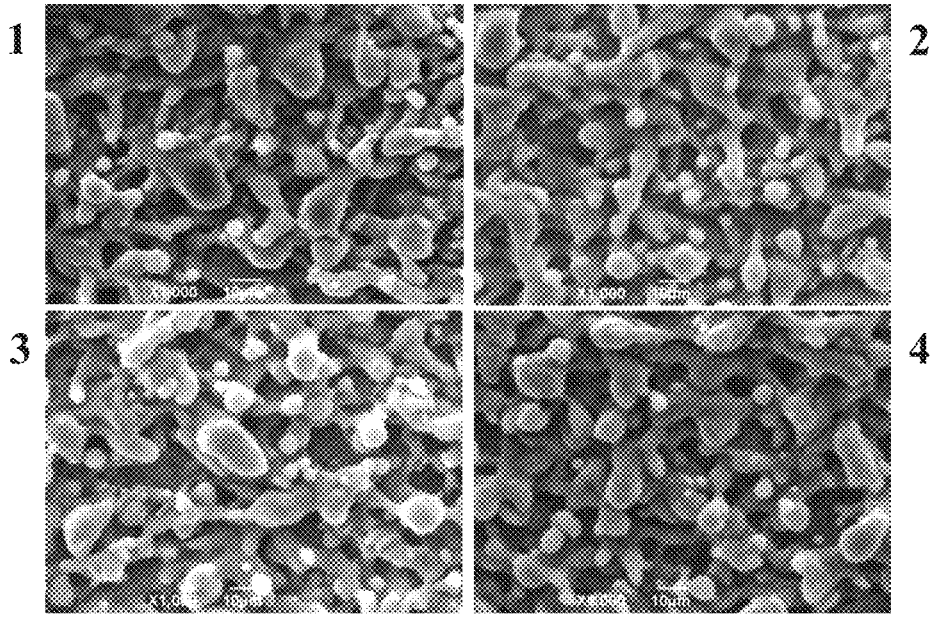
FIG. 1 shows SEM photographs of roughened surfaces of printing form precursors which have been subjected to a method of the present invention.

In the following Examples the equipment described in Table 1 was used where referred to by the name in the "name" column of the table.

TABLE 1

| Name | Equipment Model | Suppliers |
|---|---|---|
| Nanosecond pulsed fibre laser | G4, 1064 nm, 70 W | SPI Lasers UK Ltd. |
| Picosecond laser | FemtoPower1060-HE, 1064 nm, 2 W, 40 ps, 10 uJ, 200 kHz | Fianium |

TABLE 1-continued

| Name | Equipment Model | Suppliers |
|---|---|---|
| Femtosecond laser | Libra-HE, 800 nm, 4 W, 100 fs, 1 kHz-10 kHz | Coherent |
| Sub-nanosecond laser | 1064-15 W | YSL Lasers Wuhan, China |
| DropMeter | A300 | Ningbo Haishu Maist Vision Inspection & Measurement Co., Ltd., China |
| Bruker | Contour GT-K0 | Bruker, Germany |
| Nikon Microscope | Ci-L | Nikon |
| SEM-HUT | JSM-6390LV | Japan |
| SEM-WUP | FEI Sirion 200 | Philips, Netherlands |
| SEM-WHUT | ULTRA PLUS-43-13 | Carl Zeiss AG, Germany |
| Ultrasonic Cleaner | JP-080B | Skymen Cleaning Equipment Shenzhen Co., Ltd |
| Aluminum | 510 mm × 400 mm × 0.275 mm | Hydro Aluminium Rolled Products GmbH, Germany |
| PS plate | 620 mm × 485 mm × 0.15 mm | LongMa Aluminum Group, Hebei China |

Unless otherwise stated in the following examples, all water contact angle values were measured using the DropMeter and all Ra and Rz values were measured using the Bruker (by light interference microscopy), according to standard procedures known in the art.

Example Set 1-Roughening With Nanosecond Laser

Samples of 99.5 wt % pure aluminium sheet were ultrasonically cleaned, firstly in acetone and secondly in deionised water, each for 5 minutes, and then dried in air. The nanosecond pulsed fibre laser was coupled to a scanning galvanometer and focusing lens to provide a spot size of 50 μm. Scanning speed and repetition rate were adjusted to provide an overlap pattern of N=#=3.39. Each sample was exposed to one of the different combinations of pulse length and pulse energy shown in Table 2. The exposure area for each combination of pulse energy and pulse length was 1 $cm^2$. Following laser processing, the water contact angle of each 1 $cm^2$ surface was measured on the Dropmeter using deionised water as the probe liquid. The metal samples were stored open to the prevailing ambient laboratory conditions of 30-35° C. and a relative humidity of 40-50% for 5 days. During this period the water contact angle was re-measured twice per day, at the start and end of each of the 5 days. Table 2 displays the final water contact angles achieved after 5 days stored in such a way.

TABLE 2

| Water contact angle (°) Pulse | Pulse length (ns, × $10^{-9}$ s) | | | | | | | | | | | | | | |
|---|---|---|---|---|---|---|---|---|---|---|---|---|---|---|---|
| Energy (mJ) | W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
| 0.60 | 0 | 9 | 0 | 0 | 0 | 0 | | | | | | | | | |
| 0.58 | 0 | 10 | 0 | 10 | 9 | 12 | 7 | | | | | | | | |
| 0.56 | 10 | 13 | 13 | 9 | 12 | 14 | 0 | | | | | | | | |
| 0.54 | 0 | 22 | 20 | 13 | 0 | 12 | 12 | | | | | | | | |
| 0.52 | 0 | 22 | 42 | 27 | 11 | 21 | 12 | 18 | | | | | | | |
| 0.50 | 9 | 19 | 62 | 58 | 22 | 22 | 11 | 48 | 15 | | | | | | |
| 0.48 | 18 | 90 | 79 | 77 | 35 | 28 | 21 | 62 | 27 | 34 | | | | | |
| 0.46 | 38 | 90 | 29 | 88 | 132 | 28 | 83 | 55 | 23 | 21 | 27 | | | | |
| 0.44 | 92 | 114 | 96 | 96 | 98 | 112 | 84 | 39 | 38 | 50 | 47 | 75 | | | |
| 0.42 | 94 | 97 | 93 | 87 | 92 | 100 | 100 | 80 | 63 | 60 | 37 | 137 | 37 | | |
| 0.40 | 90 | 88 | 95 | 98 | 61 | 32 | 93 | 127 | 76 | 74 | 87 | 75 | 93 | 100 | |
| 0.38 | | 90 | 91 | 137 | 110 | 130 | 105 | 136 | 112 | 63 | 120 | 140 | 145 | 128 | |
| 0.36 | | 86* | 89 | 88 | 134 | 83 | 139 | 113 | 132 | 149 | 150 | 140 | 148 | 114 | 139 |

TABLE 2-continued

| | | | | | | | | | | | | | | | |
|---|---|---|---|---|---|---|---|---|---|---|---|---|---|---|---|
| 0.34 | | | | 88 | 88 | 111 | 140 | 100 | 138 | 144 | 138 | 133 | 128 | 97 | 141 |
| 0.32 | | | | | | 90 | 84 | 98 | 138 | 140 | 135 | 99 | 126 | 97 | 102 |
| 0.30 | | | | | | | 86 | 91 | 89 | 136 | 134 | 94 | 23 | 88 | 92 |
| 0.28 | | | | | | | 81* | 90* | 89 | 93 | 128 | 93 | 52 | 86 | 84 |
| 0.26 | | | | | | | 88* | 94* | 88* | 93 | 93 | 90 | 75 | 86 | 73 |
| 0.24 | | | | | | | 85* | 88* | 89* | 91* | 93* | 90 | 99 | 88 | 83 |
| 0.22 | | | | | | | | 88* | 90* | 91* | 91* | 91* | 92 | 88 | 87 |
| 0.20 | | | | | | | | 82* | 89* | 91* | 91* | 89* | 88* | 86* | 90 |
| 0.18 | | | | | | | | | 87* | 88* | 88* | 88* | 90* | 81* | 91* |
| 0.16 | | | | | | | | | 88* | 87* | 87* | 89* | 90* | 91* | 90* |
| 0.14 | | | | | | | | | 90* | 90* | 87* | 89* | 91* | 86* | 90* |
| 0.12 | | | | | | | | | 87* | 88* | 90* | 90* | 91* | 89* | 88* |
| 0.10 | | | | | | | | | 90* | 90* | 90* | 89* | 87* | 87* | 86* |

| Water contact angle (°) Pulse | Pulse length (ns, × $10^{-9}$ s) | | | | | | | | | | | | |
|---|---|---|---|---|---|---|---|---|---|---|---|---|---|
| Energy (mJ) | W16 55 | W17 50 | W18 45 | W19 40 | W20 36 | W21 33 | W22 30 | W23 26 | W24 23 | W25 20 | W26 16 | W27 13 | W28 10 |
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.30 | 48 | 80 | 78 | | | | | | | | | | |
| 0.28 | 99 | 39 | 72 | 77 | | | | | | | | | |
| 0.26 | 123 | 123 | 138 | 146 | | | | | | | | | |
| 0.24 | 123 | 106 | 127 | 134 | 102 | | | | | | | | |
| 0.22 | 121 | 114 | 120 | 123 | 134 | 139 | | | | | | | |
| 0.20 | 91 | 98 | 118 | 96 | 117 | 128 | 125 | | | | | | |
| 0.18 | 102* | 93 | 108 | 90 | 80 | 90 | 90 | 84 | | | | | |
| 0.16 | 86* | 88* | 84 | 90 | 97 | 89 | 89 | 88 | | | | | |
| 0.14 | 92* | 90* | 88* | 91* | 91 | 94 | 91 | 90 | 114 | | | | |
| 0.12 | 88* | 87* | 88* | 89* | 86* | 91 | 92 | 90 | 114 | 89 | | | |
| 0.10 | 87* | 87* | 89* | 87* | 89* | 91* | 91* | 89 | 89 | 90 | 89 | | |

*Denotes that the method produced a "polishing" effect and not a "roughened surface".

Example Set 2-Water Contact Angle Data

Samples of 99.5 wt % pure aluminium were ultrasonically cleaned in acetone and then deionised water, each for 5 minutes. The surface was processed in 1×1 $cm^2$ sections using the nanosecond pulsed fibre laser over a wide range of pulse energy and pulse length combinations (see Table 3) where each 1×1 $cm^2$ unit was processed using a unique combination of these parameters. The laser beam had a diameter of 50 μm and the scanning rate was adjusted to provide an overlap of N=#=3.39. After processing the samples were heated in an oven without fan assistance for 2 hours, cooled and the water contact angle was measured with the DropMeter. Table 3 displays the results. These results show the greater proportion of the pulse energy and pulse length combinations had become superhydrophobic. The Ra and Rz of the samples was also measured on the Bruker and these data are displayed in Tables 4 and 5 respectively which clearly show that a very wide range of roughnesses are generated and that the highest values of Ra and Rz reside in the areas of highest pulse energies and pulse lengths and vice versa for the lowest values. It can be seen that superhydrophobic surfaces can be generated in both of these regions and it seems that roughness itself is not the cause of the superhydrophobicity. We can also see that, at the very lowest pulse energies and pulse lengths, topographies consistent with currently available commercial printing plates is achieved.

TABLE 3 water contact angle data

| Water contact angle (°) Pulse energy (mJ) | Pulse length (ns, × $10^{-9}$ s) W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
|---|---|---|---|---|---|---|---|---|---|---|---|---|---|---|---|
| 0.60 | 155.5 | 0 | 0+ | 0+ | 152.5 | 100.4 | | | | | | | | | |
| 0.58 | 142.2 | 23.8 | 22.2 | 0+ | 155.1 | 156.4 | | | | | | | | | |
| 0.56 | 134.7 | 157.7 | 166.6 | 0+ | 156.5 | 157.1 | | | | | | | | | |
| 0.54 | 139.8 | 145.5 | 45.9 | 24 | 155.3 | 159.7 | | | | | | | | | |
| 0.52 | 136.2 | 147.2 | 150.3 | 89.6 | 155.8 | 156.5 | | | | | | | | | |
| 0.50 | 133 | 146.1 | 153.8 | 53.6 | 154.5 | 160 | 158.3 | | | | | | | | |
| 0.48 | 142 | 146.7 | 160.2 | 157.9 | 156.5 | 157.1 | 160 | | | | | | | | |
| 0.46 | 148.2 | 148.6 | 138.4 | 152.6 | 160.6 | 162.5 | 160.8 | 167.4 | 155.8 | | | | | | |
| 0.44 | 159.8 | 146.2 | 157.3 | 140.6 | 151.8 | 149 | 148.7 | 163.3 | 158.6 | | | | | | |
| 0.42 | | | | | | 159.4 | 159.9 | 156.2 | 153.5 | 154.1 | | | | | |
| 0.40 | | | | | | 164.4 | 157.7 | 162.5 | 154.5 | 158.9 | 157 | | | | |
| 0.38 | | | | | | 165.6 | 158.5 | 161 | 155.7 | 152.6 | 164.7 | 170.4 | | | |
| 0.36 | | | | | | | 172.2 | 160.7 | 159 | 153.7 | 155.4 | 165.8 | 151.5 | | |
| 0.34 | | | | | | | 179.5 | 161.2 | 152 | 159.3 | 168.4 | 160.9 | 151.9 | 154.5 | |
| 0.32 | | | | | | | | 169.3 | 176.3 | 168.8 | 159.6 | 166.7 | 157.1 | 162.2 | 158.7 |
| 0.30 | | | | | | | | | 167.5 | 172.2 | 158.9 | 165.9 | 157.7 | 171.4 | 168 |
| 0.28 | | | | | | | | | | | 165 | 154.1 | 159.2 | 163.1 | 163 |
| 0.26 | | | | | | | | | | | | | 166.2 | 159.5 | 166.8 |
| 0.24 | | | | | | | | | | | | | 159.7 | 163.6 | 162.9 |
| 0.22 | | | | | | | | | | | | | | | 160.2 |
| 0.20 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.10 | | | | | | | | | | | | | | | |
| 0.80 | | | | | | | | | | | | | | | |

| Water contact angle (°) Pulse energy (mJ) | Pulse length (ns, × $10^{-9}$ s) W16 55 | W17 50 | W18 45 | W19 40 | W20 36 | W21 33 | W22 30 | W23 26 | W24 23 | W25 20 | W26 16 | W27 13 | W28 10 |
|---|---|---|---|---|---|---|---|---|---|---|---|---|---|
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.30 | | | | | | | | | | | | | |
| 0.28 | 165.7 | | | | | | | | | | | | |
| 0.26 | 167 | 157.3 | 159.7 | | | | | | | | | | |
| 0.24 | 162.4 | 162.2 | 161 | 161.4 | | | | | | | | | |
| 0.22 | 169 | 166.3 | 170.7 | 162 | 159.5 | | | | | | | | |
| 0.20 | 166.8 | 165.4 | 164.2 | 169.5 | 166.5 | 159.4 | | | | | | | |
| 0.18 | | 170.6 | 169.7 | 167.7 | 165.4 | 155.7 | 166.5 | | | | | | |
| 0.16 | | | 179.9 | 166 | 164.2 | 166.9 | 170.9 | 165.5 | | | | | |
| 0.14 | | | | | | 162.1 | 168.1 | 166.5 | 164 | | | | |
| 0.12 | | | | | | | 172.2 | 173.7 | 166 | 170.5 | | | |
| 0.10 | | | | | | | | 164.5 | 165.2 | 168.6 | 165.6 | | |
| 0.80 | | | | | | | | | | | | 145 | |

TABLE 4

Ra data

| Ra (μm) Pulse energy (mJ) | Pulse length (ns, × $10^{-9}$ s) W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
|---|---|---|---|---|---|---|---|---|---|---|---|---|---|---|---|
| 0.6 | 8.56 | 9.186 | 8.393 | | | | | | | | | | | | |
| 0.58 | 9.164 | 9.637 | 8.794 | 10.333 | | | | | | | | | | | |
| 0.56 | 9.54 | 8.996 | 10.45 | 10.07 | 8.888 | | | | | | | | | | |
| 0.54 | 10.631 | 9.671 | 9.04 | 10.02 | 8.077 | | | | | | | | | | |
| 0.52 | 9.239 | 8.914 | 8.681 | 9.728 | 8.885 | 7.786 | | | | | | | | | |
| 0.5 | 7.121 | 8.067 | 7.899 | 8.987 | 8.445 | 8.951 | 7.488 | | | | | | | | |
| 0.48 | 6.531 | 7.253 | 7.501 | 9.076 | 8.273 | 8.275 | 7.533 | 8.052 | | | | | | | |
| 0.46 | 6.37 | 6.399 | 7.006 | 8.476 | 8.028 | 9.646 | 7.735 | 8.992 | 5.605 | | | | | | |
| 0.44 | 5.22 | 5.263 | 5.983 | 7.123 | 6.82 | 7.494 | 8.384 | 8.096 | 5.778 | | | | | | |
| 0.42 | | | | | | 6.189 | 6.013 | 6.289 | 5.864 | 5.159 | | | | | |
| 0.4 | | | | | | 5.844 | 5.624 | 5.821 | 5.703 | 5.323 | 5.503 | | | | |
| 0.38 | | | | | | 5.319 | 5.47 | 6.12 | 5.43 | 5.039 | 5.269 | 5.401 | | | |
| 0.36 | | | | | | | 5.13 | 5.43 | 4.98 | 4.911 | 5.604 | 5.563 | 3.797 | | |
| 0.34 | | | | | | | 4.544 | 4.981 | 4.713 | 4.55 | 5.001 | 5.329 | 3.765 | 3.398 | |
| 0.32 | | | | | | | | 4.501 | 4.093 | 3.986 | 4.62 | 4.59 | 3.556 | 3.279 | 3.338 |
| 0.3 | | | | | | | | | 3.669 | 3.526 | 4.332 | 4.322 | 3.478 | 3.235 | 3.227 |
| 0.28 | | | | | | | | | | | 3.506 | 3.818 | 3.212 | 3.179 | 3.086 |
| 0.26 | | | | | | | | | | | | | 3.163 | 2.849 | 2.999 |
| 0.24 | | | | | | | | | | | | | 2.793 | 2.459 | 2.63 |
| 0.22 | | | | | | | | | | | | | | | |
| 0.2 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.1 | | | | | | | | | | | | | | | |
| 0.8 | | | | | | | | | | | | | | | |

| Ra (μm) Pulse energy (mJ) | Pulse length (ns, × $10^{-9}$ s) W16 55 | W17 50 | W18 45 | W19 40 | W20 36 | W21 33 | W22 30 | W23 26 | W24 23 | W25 20 | W26 16 | W27 13 | W28 10 |
|---|---|---|---|---|---|---|---|---|---|---|---|---|---|
| 0.6 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.5 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.4 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.3 | | | | | | | | | | | | | |
| 0.28 | 3.07 | | | | | | | | | | | | |
| 0.26 | 3.019 | 2.211 | 2.17 | | | | | | | | | | |
| 0.24 | 2.843 | 2.059 | 1.901 | 2.034 | | | | | | | | | |
| 0.22 | 2.609 | 2.016 | 1.817 | 1.72 | 1.801 | | | | | | | | |
| 0.2 | 2.249 | 1.904 | 1.605 | 1.704 | 1.746 | 1.361 | | | | | | | |
| 0.18 | | 1.705 | 1.571 | 1.544 | 1.625 | 1.337 | 1.225 | | | | | | |
| 0.16 | | | 1.434 | 1.397 | 1.491 | 1.272 | 1.2 | 1.155 | | | | | |
| 0.14 | | | | | | 1.131 | 1.083 | 1.083 | 1.095 | | | | |
| 0.12 | | | | | | | 0.928 | 0.913 | 0.953 | 1.055 | | | |
| 0.1 | | | | | | | | 0.462 | 0.747 | 0.782 | 0.771 | | |
| 0.8 | | | | | | | | | | | | 0.62 | |

TABLE 5

Rz data

| | Pulse length (ns, × $10^{-9}$ s) | | | | | | | | | | | | | | |
|---|---|---|---|---|---|---|---|---|---|---|---|---|---|---|---|
| Rz (μm) | W0 | W1 | W2 | W3 | W4 | W5 | W6 | W7 | W8 | W9 | W10 | W11 | W12 | W13 | W14 |
| Pulse energy (mJ) | 240 | 220 | 200 | 175 | 160 | 145 | 130 | 120 | 115 | 105 | 100 | 90 | 80 | 65 | 58 |
| 0.6 | 77.9 | 79.9 | 71.5 | | | | | | | | | | | | |
| 0.58 | 81.7 | 82.1 | 75.2 | 93.3 | | | | | | | | | | | |
| 0.56 | 98.2 | 83.2 | 75.8 | 85.4 | 97.8 | | | | | | | | | | |
| 0.54 | 102.7 | 87.2 | 85.7 | 90.2 | 87.4 | | | | | | | | | | |
| 0.52 | 105.1 | 87.8 | 75.2 | 80.8 | 113.0 | 92.5 | | | | | | | | | |
| 0.5 | 69.9 | 70.6 | 73.9 | 77.2 | 111.9 | 82.9 | 73.2 | | | | | | | | |
| 0.48 | 69.5 | 88.2 | 71.1 | 72.8 | 101.0 | 79.4 | 72.3 | 76.4 | | | | | | | |
| 0.46 | 73.4 | 69.9 | 68.9 | 80.4 | 74.0 | 108.2 | 77.4 | 82.0 | 58.3 | | | | | | |
| 0.44 | 56.1 | 57.3 | 62.7 | 91.4 | 73.9 | 68.5 | 73.8 | 73.1 | 59.2 | | | | | | |
| 0.42 | | | | | | 66.1 | 55.3 | 63.1 | 56.9 | 50.2 | | | | | |
| 0.4 | | | | | | 58.9 | 74.7 | 52.4 | 55.0 | 51.7 | 51.2 | | | | |
| 0.38 | | | | | | 53.4 | 76.5 | 55.8 | 54.3 | 49.5 | 54.0 | 51.8 | | | |
| 0.36 | | | | | | | 50.2 | 57.7 | 51.0 | 52.6 | 54.0 | 49.0 | 42.4 | | |
| 0.34 | | | | | | | 47.2 | 62.9 | 52.1 | 47.8 | 55.0 | 53.2 | 44.2 | 39.3 | |
| 0.32 | | | | | | | | 77.7 | 48.8 | 45.5 | 47.5 | 49.4 | 41.2 | 37.7 | 43.1 |
| 0.3 | | | | | | | | | 47.0 | 45.1 | 46.7 | 49.1 | 42.1 | 39.8 | 37.2 |
| 0.28 | | | | | | | | | | | 40.1 | 41.7 | 43.7 | 42.3 | 42.3 |
| 0.26 | | | | | | | | | | | | | 44.5 | 33.9 | 36.2 |
| 0.24 | | | | | | | | | | | | | 37.9 | 34.6 | 33.0 |
| 0.22 | | | | | | | | | | | | | | | |
| 0.2 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.1 | | | | | | | | | | | | | | | |
| 0.8 | | | | | | | | | | | | | | | |

| | Pulse length (ns, × $10^{-9}$ s) | | | | | | | | | | | | |
|---|---|---|---|---|---|---|---|---|---|---|---|---|---|
| Rz (μm) | W16 | W17 | W18 | W19 | W20 | W21 | W22 | W23 | W24 | W25 | W26 | W27 | W28 |
| Pulse energy (mJ) | 55 | 50 | 45 | 40 | 36 | 33 | 30 | 26 | 23 | 20 | 16 | 13 | 10 |
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.30 | | | | | | | | | | | | | |
| 0.28 | 49.0 | | | | | | | | | | | | |
| 0.26 | 38.2 | 30.1 | 26.9 | | | | | | | | | | |
| 0.24 | 39.5 | 26.9 | 27.7 | 30.5 | | | | | | | | | |
| 0.22 | 33.1 | 27.3 | 25.9 | 24.1 | 26.2 | | | | | | | | |
| 0.20 | 31.8 | 27.4 | 22.1 | 28.5 | 23.8 | 22.7 | | | | | | | |
| 0.18 | | 23.5 | 21.8 | 21.6 | 22.0 | 24.3 | 19.7 | | | | | | |
| 0.16 | | | 21.3 | 21.5 | 20.6 | 23.7 | 24.5 | 17.7 | | | | | |
| 0.14 | | | | | | 18.6 | 23.0 | 16.6 | 17.2 | | | | |
| 0.12 | | | | | | | 19.2 | 17.2 | 19.1 | 24.6 | | | |
| 0.10 | | | | | | | | 15.9 | 17.9 | 20.8 | 20.6 | | |
| 0.80 | | | | | | | | | | | | 11.9 | |

Example Set 2-Repeated Roughening Cycles

A commercially available sample of a conventionally exposed and coated lithographic printing plate provided by Longma of China, was cut into a 5×5 cm square and the coating removed by repeated washing with acetone to reveal the electrochemically grained and anodised substrate, then dried in air. The nanosecond pulsed fibre laser at 1064 nm was used to process four 1 $cm^2$ sections (labelled sections 1-4) onto the exposed lithographic substrate using a pulse length of 100 ns and a pulse energy of 0.32 mJ whilst the spot laser diameter was 50 μm and the scan rate was adjusted to provide an overlap of N=#=3.39. The four roughened sections were measured for water contact angle and found to be superhydrophilic with a water contact angle of 0°. The sample was then placed in an oven at 100° C. for 2 hours. After cooling to ambient temperature, all sections were retested for water contact angle and were all found to be superhydrophobic with a water contact angle of 161°. All four sections were then exposed using the picosecond pulsed laser at a pulse energy of 8.5 μJ and a pulse length of 80 ps, to represent an imaging process (exposure 1). The laser beam diameter was 16.5 μm and scan speeds were set to achieve an overlap pattern of N=#=2.5 (this overlap pattern was selected because previous work varying overlap from N=#=0.5 to N=#=8.0 on electro-polished metal identified that between N=#=2.0 to N=#=3.0 the surface is rendered hydrophobic to a greater degree than other overlap patterns). Measurement of the water contact angle revealed that all four sections had become superhydrophilic with a water contact angle measurement of 0°. The samples were returned to the oven for 3 hours at 100° C., cooled to ambient temperature and each section measured for water contact angle. All of the sections were shown to be superhydrophobic again (see Table 6). Sections 2-4 were then processed again with the picosecond laser under exactly the same conditions as in the first exposure, to become superhydrophilic (exposure 2). After heating at 100° C. for 3 hours these three freshly exposed sections returned to a superhydrophobic form with an average water contact angle of 158°. Sections 3-4 were then exposed for a third time to the same picosecond processing conditions as previously conducted and were rendered superhydrophilic (exposure 3). Heating in an oven at 100° C. overnight returned these sections to a superhydrophobic state with an average water contact angle of 157°. Section 4 was exposed for a fourth time to the picosecond laser processing under exactly the same conditions as previously conducted to render it yet again superhydrophilic (exposure 4). Heating in an oven for 3 hours at 100° C. returned section 4 yet again to a superhydrophobic state with a water contact angle of 157° . These results are summarized in Table 6 and show that the process of roughening and conversion to a hydrophobic state can be repeated on the same substrate without diminishing the effect of the roughening and conversion and without damaging said substrate. This is confirmed by the SEM pictures of FIG. 1 showing sections 1-4 after the four cycles of picosecond exposure and conversion as described above.

TABLE 6

| Water contact angle (°) | Section | | | | Average water |
|---|---|---|---|---|---|
| Exposure: | 1 | 2 | 3 | 4 | contact angle (°) |
| Roughening | | 0 | | | — |
| Heat - 100° C. 2 hours | | 161 | | | 161 |
| ps exposure 1 | 0 | 0 | 0 | 0 | 0 |
| Heat - 100° C. 3 hours | | 159 | | | 159 |
| ps exposure 2 | 163 | 0 | 0 | 0 | — |
| Heat - 100° C. 3 hours | 161 | 157 | 158 | 158 | 158 |
| ps exposure 3 | 155 | 156 | 0 | 0 | — |
| Heat - 100° C. 11 hours | 156 | 162 | 162 | 151 | 157 |
| ps exposure 4 | 161 | 159 | 156 | 0 | — |
| Heat - 100° C. 3 hours | 154 | 147 | 150 | 157 | 152 |

Example Set 3a-Roughening Under Ar

Figure 2:
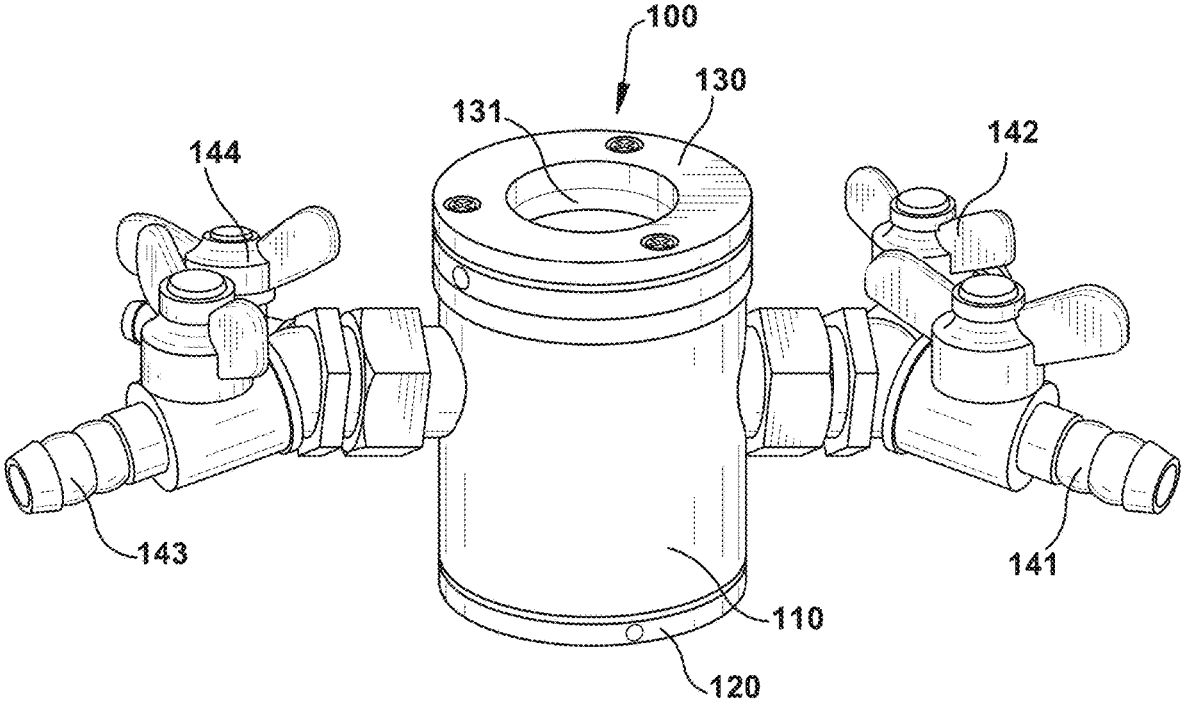
FIG. 2 shows a perspective view of an environmentally controlled laser processing chamber used in a method of the present invention.

FIG. 2 shows an environmentally controlled laser processing chamber (100) we have designed. The main chamber (110) has an internal platform (not shown) which supports a metal sample which is introduced by unscrewing the bottom section (120) containing the platform. The top section (130) contains a glass window (131) coated to maximise transmission of 1064 nm wavelength radiation. A power meter was used to measure the power from the laser beam at the height of the sample platform with and without the coated glass window and we recorded no measurable difference in incident power. The taps (141-144) are connected to the sides of the chamber to allow different atmospheres, i.e. gases, to be introduced into the chamber. The taps can then be closed to seal the unit or the gas can be allowed to flow through the chamber. In addition to changing the gaseous composition of the chamber a vacuum can be applied or a liquid (chemically inert to the components of the chamber) can be inserted to cover the sample.

4 cm diameter disks were cut from 99.5 wt % pure aluminium sheet which had been ultrasonically cleaned in acetone then deionised water for 5 minutes each (this is really a precaution to avoid contaminating the chamber, not an essential process). A disk sample was placed in the chamber under ambient conditions and was laser polished to provide a uniform surface, using the nanosecond pulsed fibre laser at a pulse length of 105 ns and a pulse energy of 0.20 mJ. The laser beam diameter at the processing surface was 50 μm and scanning rates were adjusted to provide an overlap pattern of N=#=3.39.

One of the taps was then connected to a cylinder of argon gas which was allowed to flow through the cell and out of another tap. The polished surface was then exposed using the same laser at a variety of pulse lengths and pulse energies that we have shown to provide roughening and which take at least 2-3 days to become hydrophobic. Following laser processing, the water contact angle was measured immediately and thereafter over a range of times elapsed after processing from 6 minutes to 2 days. Tables 7, 8 and 9 show the results. These results show that some of these samples become hydrophobic after just 30 minutes. It is known from previous work that a water contact angle of >60° is, in fact, sufficient to provide ink and water discrimination on a printing press and some of these samples achieve that level after just 6 minutes under ambient conditions.

TABLE 7

| Water contact angle (°) | | | | | | | | | |
|---|---|---|---|---|---|---|---|---|---|
| Pulse | Pulse length | Time after exposure (hours) at ambient temperature | | | | | | | |
| Energy (mJ) | (ns, $\times 10^{-9}$ s) | t = 0 0 | t = 1 0.1 | t = 2 0.3 | t = 3 0.5 | t = 4 1 | t = 5 2 | t = 6 12 | t = 7 16 |
| 0.22 | 36 | 0 | 0 | 0 | 49 | 94 | 79 | 107 | 107 |
| 0.20 | 36 | 0 | 0 | 20 | 20 | 25 | 23 | 67 | 68 |
| 0.18 | 36 | 0 | 0 | 0 | 81 | 85 | 92 | 103 | 99 |
| 0.16 | 36 | 0 | 17 | 14 | 23 | 24 | 35 | 69 | 72 |
| 0.20 | 33 | 0 | 0 | | 0 | 0 | 16 | 52 | 56 |
| 0.18 | 33 | 0 | 24 | | 28 | 29 | 35 | 81 | 79 |
| 0.16 | 33 | 0 | 24 | | 72 | 83 | 86 | 93 | 92 |
| 0.14 | 33 | 0 | 0 | | | 25 | 17 | 66 | 68 |
| 0.18 | 30 | 0 | 0 | 0 | 0 | 0 | 20 | 57 | 63 |
| 0.16 | 30 | 0 | 0 | 0 | 33 | 21 | 22 | 63 | 69 |
| 0.14 | 30 | 0 | 0 | 0 | 0 | 0 | 13 | 52 | 64 |
| 0.16 | 26 | 42 | 78 | 89 | 96 | 98 | 95 | 95 | 98 |
| 0.14 | 26 | 47 | 63 | 94 | 84 | 81 | 101 | 81 | 81 |
| 0.12 | 26 | 42 | 64 | 57 | 86 | 95 | 94 | 83 | 76 |
| 0.14 | 23 | 0 | 56 | 80 | 72 | 70 | 70 | 85 | 74 |
| 0.12 | 23 | 0 | 70 | 98 | 96 | 98 | 84 | 80 | 80 |
| 0.10 | 23 | 21 | 66 | 82 | 83 | 82 | 77 | 81 | 79 |
| 0.12 | 20 | 0 | 0 | 0 | 0 | 0 | | 56 | 49 |
| 0.10 | 20 | 0 | 0 | 0 | 0 | 0 | | 53 | 45 |

TABLE 8

| Water contact angle (°) | | | | | | | | | | | |
|---|---|---|---|---|---|---|---|---|---|---|---|
| Pulse | Pulse | Time after exposure (hours) at ambient temperature | | | | | | | | | |
| Energy (mJ) | length (ns, $\times 10^{-9}$ s) | t = 0 0 | t = 1 0.1 | t = 2 0.3 | t = 3 0.5 | t = 4 1 | t = 5 2 | t = 6 3 | t = 7 4 | t = 8 21 | t = 9 47 |
| 0.22 | 36 | 0 | 0+ | 0+ | 0+ | 0+ | 0+ | 24 | 21 | 96 | 95 |
| 0.20 | 36 | 0 | 69 | 56 | 81 | 85 | 79 | 95 | 91 | 80 | 109 |
| 0.18 | 36 | 0 | 77 | 89 | 84 | 81 | 69 | 88 | 84 | 93 | 103 |
| 0.16 | 36 | 0 | 36 | 49 | 83 | 69 | 79 | 83 | 85 | 79 | 101 |
| 0.34 | 105 | 0 | 0 | 0+ | 0+ | 0+ | 0+ | 0+ | 60 | 85 | 87 |
| 0.34 | 100 | 0 | 10 | 15 | 13 | 16 | 23 | 24 | 80 | 89 | 86 |
| 0.34 | 90 | 0 | 0+ | 19 | 0+ | 0+ | 17 | 46 | 68 | 96 | 118 |

TABLE 9

| Water contact angle (°) | | Time after exposure (hours) at ambient temperature | | | | | | |
|---|---|---|---|---|---|---|---|---|
| Pulse | Pulse | | | | | | | |
| Energy (mJ) | length (ns, $\times 10^{-9}$ s) | t = 0 0 | t = 1 0.1 | t = 2 0.3 | t = 3 0.5 | t = 4 1 | t = 5 16 | t = 6 24 |
| 0.56 | 240 | 0 | 48 | 66 | 95 | 102 | 65 | 99 |
| 0.54 | 240 | 0 | 52 | 68 | 79 | 92 | 49 | 49 |
| 0.52 | 240 | 0 | 62 | 68 | 88 | 94 | 92 | 100 |
| 0.50 | 240 | 0 | 61 | 90 | 85 | 89 | 92 | 90 |
| 0.48 | 130 | 0 | 0 | 0 | 27 | 55 | 79 | 98 |
| 0.46 | 130 | 0 | 0 | 0 | 44 | 47 | 69 | 97 |
| 0.44 | 130 | 0 | 0+ | 0+ | 74 | 86 | 105 | 99 |
| 0.42 | 130 | 0 | 0 | 0 | 46 | 55 | 91 | 93 |
| 0.44 | 100 | 0 | 27 | 58 | 87 | 84 | 85 | 103 |
| 0.42 | 100 | 0 | 34 | 46 | 78 | 65 | 100 | 102 |
| 0.40 | 100 | 0 | 37 | 78 | 91 | 108 | 113 | 112 |
| 0.38 | 100 | 0 | 43 | 70 | 76 | 107 | 104 | 120 |
| 0.36 | 100 | 0 | 44 | 73 | 75 | 83 | 86 | 118 |
| 0.28 | 55 | 0 | 0 | 39 | 65 | 74 | 91 | 86 |
| 0.26 | 55 | 0 | 0 | 52 | 78 | 60 | 89 | 91 |
| 0.24 | 55 | 0 | 0 | 61 | 58 | 72 | 93 | 87 |
| 0.22 | 55 | 0 | 0 | 77 | 70 | 85 | 90 | 86 |

0+ Denotes a water contact angle which is not zero but large enough to be measured.

Example Set 3b-Roughening Under Controlled Atmospheres

Twelve 4 cm diameter samples were cut from a sheet of 99.5 wt % pure aluminium, ultrasonically cleaned in acetone followed by deionised water, both for 5 minutes and dried in air. Six bottled gases were used in the experiment, namely, oxygen, nitrogen, helium, argon, carbon dioxide and bottled 'air' which consisted of an 80:20 mix of nitrogen and oxygen. The latter gas was used in place of normal air to eliminate any artefacts that may have been generated by the other gases flowing through the processing chamber as opposed to static atmospheric air. Two of each of the sample disks were assigned to each gas—one to be kept at ambient conditions for the duration of the post-processing time and one to be heated for various times. The nanosecond pulsed fibre laser was used for this experiment with a 50 μm beam diameter and scan speeds adjusted to provide an overlap pattern of N =#=3.39 for all exposures. The environmental control chamber of FIG. 2 was placed under the laser so that the focal plane of the laser was at the level of the internal platform. A sample was placed on the platform and the chamber closed. Prior to roughening, the samples were laser polished using the laser with a pulse length of 105 ns, a pulse energy of 0.20 mJ and an overlap pattern of N=#=3.39 to produce a uniform starting surface for the samples. In the first set, oxygen from a pressurised bottle was attached to one tap of the chamber via a rubber hose, both taps were opened and the gas valve opened to allow oxygen to flow through the chamber. Four 1×1cm$^2$ squares were processed by the laser using a pulse length of 16 ns and a pulse energy of 0.10 mJ with an overlap of N=#=3.39. This sample was kept at ambient conditions and each of the four squares was used to measure the water contact angle at 30, 60, 90 and 120 minutes after processing. This whole process was repeated to produce an identical sample that was then cut into four separate pieces, each containing a 1×1cm$^2$ square, and the four pieces were subjected to heat at 100° C. for 30, 60, 90 or 120 minutes, cooled to ambient in air and then measured for water contact angle. This whole process was repeated for each gas in turn with further sets of samples. The samples were also tested on the Bruker for Ra and Rz and all of the data are displayed in Table 9b. Inspection strongly suggests that the inert gases inhibit the heat developable occurrance of superhydrophobic surfaces with their water contact angle not rising above 120°, whilst the more reactive gases produce, in nearly every individual sample, water contact angles above 150° with oxygen and bottled air being above 160°, even above 170° in some cases. Additionally, there appears to be no obvious correlation between the roughness parameters Ra and Rz, water contact angle and ambient conditions versus heating.

TABLE 9B

| Gas | Time | Condition | Ra (μm) | Rz (μm) | Water contact angle (°) | Increase over ambient (°) |
|---|---|---|---|---|---|---|
| oxygen | 30 mins | Ambient | 0.960 | 17.19 | 0 | 101 |
| | | Heat | 0.964 | 16.05 | 101 | |
| | 60 mins | Ambient | 0.688 | 12.14 | 0 | 165 |
| | | Heat | 0.627 | 11.20 | 165 | |
| | 90 mins | Ambient | 0.694 | 14.09 | 0 | 169 |
| | | Heat | 0.671 | 12.81 | 169 | |
| | 120 mins | Ambient | 0.972 | 15.92 | 0 | 163 |
| | | Heat | 1.004 | 16.92 | 163 | |
| carbon dioxide | 30 mins | Ambient | 0.911 | 21.43 | 0 | 151 |
| | | Heat | 1.012 | 18.44 | 151 | |
| | 60 mins | Ambient | 0.870 | 16.99 | 0 | 146 |
| | | Heat | 0.980 | 18.36 | 146 | |
| | 90 mins | Ambient | 0.898 | 17.00 | 0 | 98 |
| | | Heat | 0.964 | 21.09 | 98 | |
| | 120 mins | Ambient | 0.934 | 17.86 | 0 | 154 |
| | | Heat | 0.970 | 19.62 | 154 | |
| helium | 30 mins | Ambient | 1.127 | 21.62 | 0 | 97 |
| | | Heat | 1.187 | 24.32 | 97 | |
| | 60 mins | Ambient | 1.202 | 24.09 | 53 | 67 |
| | | Heat | 1.172 | 23.41 | 120 | |
| | 90 mins | Ambient | 1.178 | 22.52 | 67 | 49 |
| | | Heat | 1.229 | 24.15 | 116 | |
| | 120 mins | Ambient | 1.227 | 20.15 | 72 | 36 |
| | | Heat | 1.141 | 21.83 | 108 | |

TABLE 9B-continued

| Gas | Time | Condition | Ra (μm) | Rz (μm) | Water contact angle (°) | Increase over ambient (°) |
|---|---|---|---|---|---|---|
| nitrogen | 30 mins | Ambient | 0.899 | 34.32 | 0 | 100 |
| | | Heat | 0.903 | 20.05 | 100 | |
| | 60 mins | Ambient | 0.859 | 21.26 | 0 | 109 |
| | | Heat | 0.900 | 20.04 | 109 | |
| | 90 mins | Ambient | 1.055 | 23.98 | 0 | 117 |
| | | Heat | 1.121 | 23.27 | 117 | |
| | 120 mins | Ambient | 0.948 | 23.89 | 0 | 116 |
| | | Heat | 0.924 | 23.10 | 116 | |
| argon | 30 mins | Ambient | 0.739 | 18.42 | 36 | 46 |
| | | Heat | 0.718 | 16.73 | 82 | |
| | 60 mins | Ambient | 0.746 | 17.72 | 49 | 54 |
| | | Heat | 0.773 | 18.70 | 103 | |
| | 90 mins | Ambient | 0.760 | 16.58 | 50 | 45 |
| | | Heat | 0.769 | 27.53 | 95 | |
| | 120 mins | Ambient | 0.753 | 16.11 | 56 | 51 |
| | | Heat | 0.751 | 17.20 | 107 | |
| bottled air | 30 mins | Ambient | 1.028 | 19.08 | 0 | 164 |
| | | Heat | 1.025 | 20.42 | 164 | |
| | 60 mins | Ambient | 1.013 | 19.30 | 0 | 171 |
| | | Heat | 1.049 | 19.58 | 171 | |
| | 90 mins | Ambient | 1.053 | 20.86 | 0 | 174 |
| | | Heat | 1.025 | 21.11 | 174 | |
| | 120 mins | Ambient | 1.067 | 20.26 | 0 | 164 |
| | | Heat | 1.087 | 19.18 | 164 | |

Example Set 4-Effect of Overlap

A sample of 99.5 wt % pure aluminium was electropolished at 20 v in a mixture of ethanol and 60% perchloric acid (4:1 v/v) for 4 minutes, maintaining the temperature between 0 and 10° C. by use of a recirculating cooling bath. The ethanol and deionised water washed sample was dried and then laser roughened at 1064 nm with a pulse length of 23 ns and a pulse energy of 0.14 mJ using the nanosecond pulsed fibre laser. The spot size was 50 μm and scanning rates were adjusted to provide a range of overlap patterns from N=#=1 to N=#=4. The samples were heated in an oven at 100° C. for 2 to 23 hours and the water contact angle of the samples were measured at each time point. The results are displayed in Table 10 and indicate that whilst all are useful, the time to produce a superhydrophobic surface is less when N=#>1.

TABLE 10

| Water contact angle (°) Time after exposure (hours) | Overlap (N × #) 1 × 1 | 2 × 2 | 3 × 3 | 4 × 4 |
|---|---|---|---|---|
| 0 | 0 | 0 | 0 | 0 |
| 2 | 107.4 | 138 | 138.9 | 102.8 |
| 4 | 123.3 | 166.5 | 158.6 | 158.6 |
| 6 | 84.5 | 160.7 | 163.7 | 166.6 |
| 18* | 118.7 | 165 | 165.1 | 160.9 |
| 23* | 152.8 | 179.6 | * | * |

*Denotes large water contact angle and low adhesion made accurate measurement impossible.

Example Set 5-Effect of Heat Treatment

Samples of 99.5 wt % pure aluminium sheet were cut and ultrasonically cleaned in acetone, followed by deionised water, both for 5 minutes. The effect of heating the printing form precursor after roughening the surface with the energy was investigated by exposing these samples using the nanosecond pulsed fibre laser at 1064 nm with a pulse length of 23 ns and a pulse energy of 0.14 and an overlap of N=#=3.39. This initially produced a uniformly hydrophilic roughened surface with a water contact angle of 0°. The samples of printing form precursor were then heated at 60, 80, 100 or 120° C. and a control sample was left at room temperature. The water contact angle was measured at 0.5, 1.0, 1.5 and 2.0 hours after exposing the samples to the pulses of electromagnetic radiation. The results are shown in Table 11 below. At room temperature no change in water contact angle was observed over the 2.0 hours of the experiment. This sample would be expected to become hydrophobic over a period of several days depending on the ambient temperature. The results of the heated samples show that heating the samples of printing form precursor after exposure to the pulses of electromagnetic radiation shortens the time required for the water contact angle to increase and the surface to become hydrophobic.

TABLE 11

| Water contact angle (°) | Temperature (° C.), volume: 5 μL | | | | |
|---|---|---|---|---|---|
| Time/hrs | RT | 60 | 80 | 100 | 120 |
| 0 | 0 | 0 | 0 | 0 | 0 |
| 0.5 | 0+ | 0+ | 71.8 | 23.8 | 66 |
| 1 | 0+ | 60.2 | 131.5 | 85.2 | 110.9 |
| 1.5 | 0+ | 98.1 | 146.4 | 142.2 | 140.1 |
| 2 | 0+ | 117.9 | 148.4 | 165.3 | 153.2 |

RT = room temperature

The procedure of Example set 5 was repeated using a range of pulses of electromagnetic radiation shown in Tables 12-14 below. After exposure of the samples to the pulses, each sample was heated in a fan oven at 100° C. and the water contact angle measured at 2 hours (Table 12), 10 hours (Table 13) and 22 hours (Table 14) post exposure. These results show that the water contact angle increased in all cases over 22 hours in the fan oven at 100° C. to render the surface of the samples uniformly hydrophobic. At room temperature the samples would be expected to achieve hydrophobicity over several days or weeks.

Heating samples with an unprocessed raw metal surface or an electrochemically polished metal surface had no effect on the water contact angle of the surfaces.

These results show that by appropriate selection of the pulse energy, pulse length, temperature of heating and time of heating, a printing form precursor with a particular water contact angle selected from the wide range covered by the examples in Tables 12-14 can be produced. The water contact angle can be selected according to the intended use of the printing form precursor.

These experiments were repeated using a static oven set at the same temperatures instead of a fan oven. These experiments showed that a static oven is more efficient at converting the hydrophilic surface to hydrophobic than a fan oven set at the same temperature.

TABLE 12

Fan oven, 100° C., 2 hours

| Water contact angle (°) Pulse | Pulse length (ns, × $10^{-9}$ s) | | | | | | | | | | | | | | |
|---|---|---|---|---|---|---|---|---|---|---|---|---|---|---|---|
| Energy (mJ) | W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
| 0.60 | 0+ | 0+ | 0+ | | | | | | | | | | | | |
| 0.58 | 0+ | 0+ | 0+ | 0+ | | | | | | | | | | | |
| 0.56 | 0+ | 0+ | 0+ | 0+ | 0+ | | | | | | | | | | |
| 0.54 | 0+ | 0+ | 0+ | 0+ | 0+ | | | | | | | | | | |
| 0.52 | 0+ | 0+ | 0+ | 0+ | 0+ | 0+ | | | | | | | | | |
| 0.50 | 0+ | 0+ | 0+ | 0+ | 0+ | 0+ | 0+ | | | | | | | | |
| 0.48 | 0+ | 0+ | 0+ | 0+ | 0+ | 0+ | 0+ | 0+ | | | | | | | |
| 0.46 | 25.2 | 22.3 | 0+ | 0+ | 0+ | 0+ | 0+ | 0+ | 0+ | | | | | | |
| 0.44 | 31.2 | 30.7 | 28.1 | 31.7 | 0+ | 0+ | 0+ | 0+ | 0+ | | | | | | |
| 0.42 | | | | | | 0+ | 0+ | 0+ | 0+ | 0+ | | | | | |
| 0.40 | | | | | | 0+ | 0+ | 0+ | 0+ | 0+ | 0+ | | | | |
| 0.38 | | | | | | 0+ | 0+ | 0+ | 0+ | 0+ | 0+ | 0+ | | | |
| 0.36 | | | | | | | 0+ | 0+ | 0+ | 0+ | 0+ | 0+ | 0+ | 0+ | 0+ |
| 0.34 | | | | | | | 0+ | 0+ | 0+ | 0+ | 0+ | 0+ | 0+ | 0+ | 0+ |
| 0.32 | | | | | | | | 21.6 | 0+ | 0+ | 0+ | 0+ | 0+ | 0+ | 0+ |
| 0.30 | | | | | | | | | 83.8 | 23.9 | 0+ | 0+ | 0+ | 0+ | 0+ |
| 0.28 | | | | | | | | | | | 34.4 | 0+ | 0+ | 0+ | 0+ |
| 0.26 | | | | | | | | | | | | | 0+ | 0+ | 0+ |
| 0.24 | | | | | | | | | | | | | 55.9 | 45.4 | 0+ |
| 0.22 | | | | | | | | | | | | | | | |
| 0.20 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.10 | | | | | | | | | | | | | | | |

| Water contact angle (°) Pulse | Pulse length (ns, × $10^{-9}$ s) | | | | | | | | | | | | |
|---|---|---|---|---|---|---|---|---|---|---|---|---|---|
| Energy (mJ) | W16 55 | W17 50 | W18 45 | W19 40 | W20 36 | W21 33 | W22 30 | W23 26 | W24 23 | W25 20 | W26 16 | W27 13 | W28 10 |
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | 0+ | | | | | | | | | | | | |
| 0.34 | 0+ | | | | | | | | | | | | |
| 0.32 | 0+ | | | | | | | | | | | | |
| 0.30 | 0+ | | | | | | | | | | | | |
| 0.28 | 0+ | | | | | | | | | | | | |
| 0.26 | 0+ | 82.8 | 26.2 | | | | | | | | | | |
| 0.24 | 0+ | 74.7 | 57.2 | 40.9 | | | | | | | | | |
| 0.22 | 17.8 | 69.7 | 61.9 | 63.4 | 55.2 | | | | | | | | |
| 0.20 | 55.2 | 88.5 | 76.9 | 77.7 | 68.7 | 86.4 | | | | | | | |
| 0.18 | | 34.3 | 96.5 | 93.5 | 87.6 | 108.4 | 75.8 | | | | | | |
| 0.16 | | | 107.1 | 98.3 | 97.8 | 120.4 | 117.1 | 126.9 | | | | | |
| 0.14 | | | | | | 158.3 | 141.6 | 139.4 | 126.3 | | | | |
| 0.12 | | | | | | | 114.5 | 115.5 | 131.4 | 121.5 | | | |
| 0.10 | | | | | | | | 129.3 | 144.8 | 119.1 | 128.4 | | |

TABLE 13

Fan oven, 100° C., 10 hours

| Water contact angle (°) Pulse | Pulse length (ns, × $10^{-9}$ s) | | | | | | | | | | | | | | |
|---|---|---|---|---|---|---|---|---|---|---|---|---|---|---|---|
| Energy (mJ) | W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
| 0.60 | 138 | 87 | 146 | | | | | | | | | | | | |
| 0.58 | 140 | 74 | 112 | 145 | | | | | | | | | | | |
| 0.56 | 147 | 89 | 99 | 139 | 166 | | | | | | | | | | |
| 0.54 | 150 | 146 | 126 | 137 | 116 | | | | | | | | | | |
| 0.52 | 152 | 144 | 148 | 146 | 128 | 89 | | | | | | | | | |
| 0.50 | 160 | 159 | 147 | 150 | 59 | 66 | 60 | | | | | | | | |
| 0.48 | 0 | 0 | 152 | 157 | 58 | 41 | 0+ | 61 | | | | | | | |
| 0.46 | 0 | 0 | 0 | 0 | 73 | 34 | 18 | 29 | 120 | | | | | | |
| 0.44 | 0 | 0 | 0 | 0 | 120 | 67 | 40 | 126 | 133 | | | | | | |
| 0.42 | | | | | | 155 | 160 | 98 | 136 | 146 | | | | | |
| 0.40 | | | | | | 155 | 57 | 91 | 138 | 87 | 146 | | | | |
| 0.38 | | | | | | 157 | 108 | 139 | 140 | 74 | 112 | 145 | | | |
| 0.36 | | | | | | | 104 | 152 | 147 | 89 | 99 | 139 | 150 | | |
| 0.34 | | | | | | | 124 | 163 | 150 | 146 | 126 | 137 | 148 | 147 | 163 |
| 0.32 | | | | | | | | 157 | 152 | 144 | 148 | 146 | 141 | 138 | 157 |
| 0.30 | | | | | | | | | 160 | 159 | 147 | 150 | 140 | 140 | 143 |
| 0.28 | | | | | | | | | | | 152 | 157 | 152 | 142 | 50 |
| 0.26 | | | | | | | | | | | | | 153 | 164 | 57 |
| 0.24 | | | | | | | | | | | | | 164 | 157 | |
| 0.22 | | | | | | | | | | | | | | | |
| 0.20 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.10 | | | | | | | | | | | | | | | |

| Water contact angle (°) Pulse | Pulse length (ns, × $10^{-9}$ s) | | | | | | | | | | | | |
|---|---|---|---|---|---|---|---|---|---|---|---|---|---|
| Energy (mJ) | W16 55 | W17 50 | W18 45 | W19 40 | W20 36 | W21 33 | W22 30 | W23 26 | W24 23 | W25 20 | W26 16 | W27 13 | W28 10 |
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.30 | 160 | | | | | | | | | | | | |
| 0.28 | 92 | | | | | | | | | | | | |
| 0.26 | 66 | 161 | 163 | | | | | | | | | | |
| 0.24 | 146 | 151 | 157 | 162 | | | | | | | | | |
| 0.22 | 139 | 155 | 159 | 158 | 160 | | | | | | | | |
| 0.20 | | 157 | 161 | 150 | 160 | 162 | | | | | | | |
| 0.18 | | 149 | 151 | 162 | 155 | 165 | 162 | | | | | | |
| 0.16 | | | 150 | 139 | 158 | 150 | 154 | 162 | | | | | |
| 0.14 | | | | | | 153 | 147 | 141 | 137 | | | | |
| 0.12 | | | | | | | 139 | 138 | 138 | 137 | | | |
| 0.10 | | | | | | | | 122 | 135 | 138 | 141 | | |

TABLE 14

Fan oven, 100° C., 22 hours

| Water contact angle (°) Pulse | Pulse length (ns, × $10^{-9}$ s) | | | | | | | | | | | | | | |
|---|---|---|---|---|---|---|---|---|---|---|---|---|---|---|---|
| Energy (mJ) | W0 240 | W1 220 | W2 200 | W3 175 | W4 160 | W5 145 | W6 130 | W7 120 | W8 115 | W9 105 | W10 100 | W11 90 | W12 80 | W13 65 | W14 58 |
| 0.60 | 143 | 147 | 146 | | | | | | | | | | | | |
| 0.58 | 146 | 156 | 154 | 166 | | | | | | | | | | | |
| 0.56 | 156 | 155 | 158 | 169 | 158 | | | | | | | | | | |
| 0.54 | 152 | 156 | 155 | 153 | 161 | | | | | | | | | | |
| 0.52 | 147 | 153 | 158 | 155 | 151 | 156 | | | | | | | | | |
| 0.50 | 149 | 150 | 154 | 156 | 149 | 147 | 163 | | | | | | | | |
| 0.48 | 148 | 148 | 152 | 153 | 148 | 150 | 153 | 168 | | | | | | | |
| 0.46 | 134 | 161 | 154 | 155 | 156 | 133 | 162 | 165 | 165 | | | | | | |
| 0.44 | 151 | 152 | 155 | 156 | 153 | 156 | 158 | 159 | 157 | | | | | | |
| 0.42 | | | | | | 155 | 159 | 158 | 140 | 154 | | | | | |
| 0.40 | | | | | | 150 | 93 | 159 | 157 | 138 | 160 | | | | |
| 0.38 | | | | | | 158 | 150 | 154 | 150 | 130 | 150 | 160 | | | |
| 0.36 | | | | | | | 137 | 165 | 150 | 141 | 149 | 153 | 166 | | |
| 0.34 | | | | | | | 145 | 161 | 151 | 151 | 140 | 152 | 155 | 169 | |
| 0.32 | | | | | | | | 156 | 153 | 155 | 154 | 156 | 152 | 159 | 155 |
| 0.30 | | | | | | | | | 156 | 148 | 162 | 160 | 149 | 152 | 157 |
| 0.28 | | | | | | | | | | | 148 | 156 | 149 | 153 | 144 |
| 0.26 | | | | | | | | | | | | | 147 | 150 | 137 |
| 0.24 | | | | | | | | | | | | | 167 | 150 | 90 |
| 0.22 | | | | | | | | | | | | | | | |
| 0.20 | | | | | | | | | | | | | | | |
| 0.18 | | | | | | | | | | | | | | | |
| 0.16 | | | | | | | | | | | | | | | |
| 0.14 | | | | | | | | | | | | | | | |
| 0.12 | | | | | | | | | | | | | | | |
| 0.10 | | | | | | | | | | | | | | | |

| Water contact angle (°) Pulse | Pulse length (ns, × $10^{-9}$ s) | | | | | | | | | | | | |
|---|---|---|---|---|---|---|---|---|---|---|---|---|---|
| Energy (mJ) | W16 55 | W17 50 | W18 45 | W19 40 | W20 36 | W21 33 | W22 30 | W23 26 | W24 23 | W25 20 | W26 16 | W27 13 | W28 10 |
| 0.60 | | | | | | | | | | | | | |
| 0.58 | | | | | | | | | | | | | |
| 0.56 | | | | | | | | | | | | | |
| 0.54 | | | | | | | | | | | | | |
| 0.52 | | | | | | | | | | | | | |
| 0.50 | | | | | | | | | | | | | |
| 0.48 | | | | | | | | | | | | | |
| 0.46 | | | | | | | | | | | | | |
| 0.44 | | | | | | | | | | | | | |
| 0.42 | | | | | | | | | | | | | |
| 0.40 | | | | | | | | | | | | | |
| 0.38 | | | | | | | | | | | | | |
| 0.36 | | | | | | | | | | | | | |
| 0.34 | | | | | | | | | | | | | |
| 0.32 | | | | | | | | | | | | | |
| 0.30 | | | | | | | | | | | | | |
| 0.28 | 148 | | | | | | | | | | | | |
| 0.26 | 132 | 165 | 161 | 154 | | | | | | | | | |
| 0.24 | 111 | 156 | 156 | 155 | | | | | | | | | |
| 0.22 | 139 | 150 | 153 | 156 | 157 | | | | | | | | |
| 0.20 | 145 | 153 | 152 | 152 | 154 | 165 | | | | | | | |
| 0.18 | | 154 | 149 | 144 | 155 | 153 | 160 | | | | | | |
| 0.16 | | | 152 | 153 | 156 | 156 | 156 | 156 | | | | | |
| 0.14 | | | | | | 157 | 149 | 146 | 141 | | | | |
| 0.12 | | | | | | | 142 | 143 | 143 | 142 | | | |
| 0.10 | | | | | | | | 133 | 150 | 138 | 143 | | |

Example Set 6-Effect of Starting Roughness

Eight samples of 99.5 wt % pure aluminium were electrochemically polished at 20 v in a mixture of ethanol and 60% perchloric acid (4:1 v/v) for various times from 0.5 to 4 minutes whilst maintaining the temperature between 0 and 10° C. by using a recirculating cooling bath. The samples were then washed with ethanol and deionised water and dried. The Ra and Rz were determined using the Bruker which showed a narrow range of Ra values between 0.100 and 0.256 μm and Rz between 2.61 and 3.76 μm. Another sample of 99.5 wt % pure aluminium was ultrasonically cleaned in acetone and then deionized water, both for 5 minutes, dried and the Ra and Rz determined on the Bruker which gave an Ra of 1.263 μm and an Rz of 20.79 μm. All of the samples were then processed with the nanosecond pulsed fibre laser at a pulse energy of 0.14 mJ and a pulse length of 23 ns. The laser beam width in the processing plane was 50 μm and the scan rate was adjusted to provide an overlap of N=#=3.39. All the samples were heated in an oven at 100° C. for various times between 2 and 23 hours and then cooled to ambient. The water contact angles of all the samples were measured and the results are displayed in Table 15.

TABLE 15

| Water contact angles (°) Heating time (hours) | Electrochemically polishing time (minutes) 0.5 | 1 | 1.5 | 2 | 2.5 | 3 | 3 | 4 | unpolished control |
|---|---|---|---|---|---|---|---|---|---|
| 0 | 0 | 0 | 0 | 0 | 0 | 0 | 0 | 0 | 0 |
| 2 | 134 | 137 | 145 | 141 | 140 | 139 | 133 | 143 | 160 |
| 4 | 157 | 161 | 159 | 162 | 163 | 159 | 157 | 161 | 163 |
| 6 | 157 | 156 | 163 | 157 | 172 | 165 | 171 | 160 | 180 |
| 18 | 164 | 164 | 161 | 160 | 164 | 153 | 163 | 163 | 168 |
| 23 | 168 | 172 | 180 | 180 | 176 | 180 | 171 | 170 | 168 |
| Ra (m) | 0.256 | 0.21 | 0.211 | 0.173 | 0.132 | 0.125 | 0.1 | 0.165 | 1.263 |
| Rz (m) | 3.76 | 3.58 | 3.71 | 3.12 | 2.41 | 2.81 | 2.61 | 3.03 | 20.79 |

The data in Table 15 show that although the Ra of the electro-polished samples varies by a factor of >10 compared to the unpolished samples, and the Rz varies by a factor of approximately 6, the rate of development of hydrophobicity and the value of the water contact angle is not affected (laser polished samples have an Ra between 0.250 and 0.350 μm and an Rz between 3.50 and 5.50 μm so closer to the electrochemically polished samples of Table 15 than the unpolished control sample).

Comparative Example 1-Roughness of a Printing Plate

Three 5×5 cm samples of a conventional printing plate, as supplied by Longma of China, were cut from different areas of the same printing plate and the coating was removed by repeated washing in acetone and then dried in air. The roughness of the surfaces was measured by the Bruker and the water contact angle measured using the DropMeter. The results are displayed in Table 16.

TABLE 16

| Sample | Water contact angle (°) | Ra (μm) | Rz (μm) | Surface area (mm) | % |
|---|---|---|---|---|---|
| 1 | 76.4 | 0.791 | 9.93 | 4.236 | 99.39 |
| 2 | 79.6 | 0.813 | 8.71 | 4.228 | 99.38 |
| 3 | 82.2 | 0.96 | 9.559 | 4.232 | 99.38 |
| Ave | 79.4 | 0.855 | 9.4 | 4.232 | 99.383 |
| STD | 2.905 | 0.092 | 0.625 | 0.004 | 0.006 |

Example Set 7-Roughening With Sub-Nanosecond Laser

A sample of 0.275 mm gauge 99.5 wt % pure aluminium sheet was ultrasonically cleaned in acetone followed by deionised water for 5 minutes each. The sub-nanosecond laser (wavelength of 1064 nm) was used for this experiment to provide a 30 pm laser beam diameter. The scan rate was adjusted to provide an overlap pattern of N=#=1. A number of 1×1 $cm^2$ squares were processed on the metal surface covering a range of pulse lengths and pulse energies as displayed in Table 17. Table 18 shows the frequency (Hz), pulse length (ns), pulse energy (uJ), peak power ($MWcm^{-2}$) and fluence ($Jcm^{-2}$) of the laser conditions used. The resulting processed sample was heated in an oven for 2 hours at 100° C. and then cooled. The water contact angle, Ra and Rz roughness were measured and are shown in Table 17. Whilst the water contact angle data is variable, probably because of the low overlap pattern (as we have seen earlier), the data does demonstrate that superhydrophobic or strongly hydrophobic surfaces can be generated at roughness values below that of a commercially available printing plate substrate. There was also no heat deformation on any of the samples.

TABLE 17

| Pulse length (frequency in KHz) | Pulse energy (μJ) | Water contact angle (°) | Ra (μm) | Rz (μm) |
|---|---|---|---|---|
| 4.14 ns (100) | 150 | 138.9 | 0.479 | 6.732 |
| 4.14 ns (100) | 120 | 140 | 0.46 | 6.18 |
| 4.14 ns (100) | 100 | 152.7 | 0.411 | 5.688 |
| 4.14 ns (100) | 74 | 143.8 | 0.401 | 8.368 |
| 4.14 ns (100) | 60 | 143.2 | 0.369 | 4.74 |
| 4.14 ns (100) | 30 | 143.4 | 0.326 | 5.771 |
| 2.31 ns (200) | 75 | 97.9 | 0.357 | 7.211 |
| 2.31 ns (200) | 50 | 128.3 | 0.336 | 9.339 |
| 2.31 ns (200) | 25 | 66.5 | 0.299 | 5.729 |
| 1.16 ns (400) | 37.5 | 127.9 | 0.314 | 5.325 |
| 1.16 ns (400) | 25 | 129.2 | 0.315 | 7.49 |
| 650 ps (500) | 30 | 122.4 | 0.311 | 6.583 |
| 650 ps (500) | 24 | 126.3 | 0.31 | 8.74 |
| 680 ps (800) | 18.75 | 108.2 | 0.319 | 9.622 |
| 680 ps (800) | 14 | 115.4 | 0.296 | 4.819 |
| 680 ps (800) | 10 | 115.3 | 0.284 | 4.415 |
| 360 ps (100) | 15 | 109.8 | 0.321 | 5.1 |
| 360 ps (100) | 12 | 122.1 | 0.314 | 7.076 |
| 360 ps (100) | 8 | 118.1 | 0.283 | 4.807 |

TABLE 18

| Frequency (Hz) | Pulse length (ns) | Pulse energy (uJ) | Peak Power ($MWcm^{-2}$) | Fluence ($Jcm^{-2}$) |
|---|---|---|---|---|
| 100 k | 4.14 | 150 | 1442 | 6 |
| | | 120 | 1153 | 4.78 |
| | | 100 | 961 | 4 |
| | | 74 | 721 | 3 |
| | | 60 | 577 | 2.4 |
| | | 30 | 288 | 1.2 |
| 200 k | 2.31 | 75 | 1292 | 3 |
| | | 50 | 861 | 2 |
| | | 25 | 431 | 1 |
| 400 k | 1.16 | 37.5 | 1286 | 1.49 |
| | | 25 | 857 | 1 |

TABLE 18-continued

| Frequency (Hz) | Pulse length (ns) | Pulse energy (uJ) | Peak Power ($MWcm^{-2}$) | Fluence ($Jcm^{-2}$) |
|---|---|---|---|---|
| 500 k | 0.68 | 30 | 1755 | 1.2 |
| | | 24 | 1404 | 0.95 |
| 800 k | | 18.75 | 1097 | 0.75 |
| | | 14 | 819 | 0.56 |
| | | 10 | 585 | 0.4 |
| 1000 k | 0.36 | 15 | 1658 | 0.6 |
| | | 12 | 1326 | 0.48 |
| | | 8 | 884 | 0.32 |

Example Set 8-Roughening With Picosecond Laser

Two samples of 99.5 wt % pure aluminium were ultrasonically cleaned in acetone followed by deionised water, both for 5 minutes, then dried in air. The picosecond laser (wavelength=1064 nm) was set up to deliver pulse energies of 8.5 μJ at a pulse length of 80 ps and the laser beam diameter at the focal plane was determined to be 16.5 μJ. By adjusting the scan and repetition rates, a series of 0.75×0.75 $cm^2$ squares were processed on each sample to provide a range of overlap patterns where N=#=1 through to N=#=5 in 0.20 increments and also N=#=6, N=#=7 and N=#=8. After processing, each square was evaluated for water contact angle which was found to be 0° for all samples. One sample was left open in the laboratory under ambient conditions (temperature between 15 and 25° C.) and the water contact angle for each square was measured two times per day for 11 days. The final water contact angle (after 11 days) of each square is displayed in Table 19 in the column headed "11 days at ambient". The other piece of aluminium containing the other set of processed samples were heated in an oven at 100° C. for 2 hours, cooled to ambient in air then each square was evaluated again for water contact angle, Ra and Rz. The results from the experiment are displayed in Table 19.

TABLE 19

| | Roughness | | Water contact angle (°) | |
|---|---|---|---|---|
| Overlap N = # | Ra (μm) | Rz (μm) | Heated | 11 days at Ambient |
| 1 × 1 | 0.178 | 2.38 | 115 | 91 |
| 1.2 × 1.2 | 0.471 | 5.77 | 137 | 90 |
| 1.4 × 1.4 | 0.37 | 5.1 | 159 | 84 |
| 1.6 × 1.6 | 0.39 | 5.7 | 164 | 93 |
| 1.8 × 1.8 | 0.401 | 5.24 | 170 | 91 |
| 2 × 2 | 0.375 | 5.08 | 166 | 90 |
| 2.2 × 2.2 | 0.416 | 5.69 | 165 | 108 |
| 2.4 × 2.4 | 0.41 | 6.66 | 154 | 121 |
| 2.6 × 2.6 | 0.378 | 5.18 | 166 | 122 |
| 2.8 × 2.8 | 0.363 | 5.87 | 158 | 124 |
| 3 × 3 | 0.366 | 5.99 | 167 | 113 |
| 3.2 × 3.2 | 0.371 | 5.66 | 165 | 99 |
| 3.4 × 3.4 | 0.413 | 6.67 | 162 | 93 |
| 3.6 × 3.6 | 0.463 | 10.2 | 163 | 71 |
| 3.8 × 3.8 | 0.386 | 9.03 | 165 | 66 |
| 4 × 4 | 0.368 | 6.05 | 158 | 97 |
| 4.2 × 4.2 | 0.352 | 5.6 | 160 | 101 |
| 4.4 × 4.4 | 0.363 | 7.5 | 165 | 80 |
| 4.6 × 4.6 | 0.372 | 6.11 | 170 | 83 |
| 4.8 × 4.8 | 0.392 | 6.99 | 162 | 58 |
| 5 × 5 | 0.409 | 6.31 | 165 | 119 |
| 6 × 6 | 0.381 | 7.27 | 168 | 84 |
| 7 × 7 | 0.386 | 7.78 | 168 | 49 |
| 8 × 8 | 0.439 | 10.54 | 165 | 40 |

The data in Table 19 show that under ambient conditions very few of the examples become hydrophobic after 11 days and none become superhydrophobic whereas all of the samples that have been heated become hydrophobic having been initially superhydrophilic after processing. From 1.4×1.4 they are, in fact, all superhydrophobic.

Example Set 9-Roughening With Femtosecond Laser

A sample of 99.5 wt % pure aluminium sheet was ultrasonically cleaned in acetone followed by deionised water for 5 minutes each and dried in air. The Femtosecond laser was used to carry out the roughening on 0.5×0.5 $cm^2$ squares on the cleaned metal surface. The laser had a beam diameter of 15 μm, a wavelength of 800 nm, a pulse length of 100 fs and a pulse energy of either 2 μJ or 5 μJ. Scan rates were adjusted as a variable to provide overlap patterns of N=#=1, 2, 3, 4 or 5. The combination of the two pulse energy variables and five overlap variables provides a total of 10 sample sets. After processing one sample of each set had their water contact angle measured immediately whilst the other sample of the sets were heated in an oven at 100° C. for times varying from 30 minutes to 2 hours. Following heating the samples were cooled to ambient in air and then their water contact angle was measured. The results are displayed in Table 20. We can see that a 1×1 overlap combined with a pulse energy of 2 μJ is not sufficient to produce a uniformly superhydrophilic surface though it is hydrophilic whilst at 5 μJ the surface is fully superhydrophilic.

Regarding the 2 μJ samples, it appears that the samples with higher overlap needed to be heated for longer to achieve the hydrophobicity. Regarding the 5 μJ samples, the samples with higher overlap did not achieve hydrophobicity on heating.

TABLE 20

| Temperature/ time of heating | Pulse energy (μm) | N: #: | 1 1 | 2 2 | 3 3 | 4 4 | 5 5 |
|---|---|---|---|---|---|---|---|
| Ambient | 2.00 | Water contact angle (°): | 40.4 | 0+ | 0+ | 0+ | 0+ |
| Ambient | 5.00 | | 0+ | 0+ | 0+ | 0+ | 0+ |
| 100° C./ 30 mins | 2.00 | | 114.8 | 41.6 | 0+ | 0+ | 0+ |
| 100° C./ 30 mins | 5.00 | | 21.7 | 0+ | 0+ | 0+ | 0+ |
| 100° C./ 60 mins | 2.00 | | 118.8 | 152.7 | 114.5 | 30.2 | 0+ |
| 100° C./ 60 mins | 5.00 | | 158.9 | 25.4 | 0+ | 0+ | 0+ |
| 100° C./ 120 mins | 2.00 | | 116 | 140.3 | 132.3 | 153.9 | 151.4 |
| 100° C./ 120 mins | 5.00 | | 167.5* | 81 | * | * | * |

0+ Denotes a water contact angle which is not zero but large enough to be measured.
* Denotes sample spontaneously turns form superhydrophobic to superhydrophilic.

Example Set 10-Simulated Recycling After Imaging

A sample of 99.5 wt % pure aluminium was electrochemically polished at 20 v in a mixture of ethanol and 60% perchloric acid (4:1 v/v) for 4 minutes, maintaining the temperature between 0 and 10° C. by using a recirculating cooling bath. The ethanol and deionised water washed sample was dried and then laser roughened using the nanosecond pulsed fibre laser at 1064 nm with a pulse length of 100 ns and a pulse energy of 0.32 mJ. The spot size was 50 μm and scanning rates were adjusted to provide an overlap pattern of N=#=3.39. The sample was left in the air at ambient conditions for 3 days after which water contact angle measurement of the surface showed it to be strongly hydrophobic with a water contact angle of 142°. The whole sample was then exposed using the Picosecond laser, also at 1064 nm, to simulate an imaging process (ps exposure 1). The Picosecond laser delivered pules having a pulse length of 8.0 μJ, a pulse length of 80 ps and a spot size of 16.5 μm. Scanning rates were adjusted to provide an overlap pattern of N=#=1. After exposure 1, re-measurement of the water contact angle showed that the whole surface was superhydrophilic with a 0° water contact angle. The sample was subsequently left in air for 45 hours until the water contact angle increased to a maximum of 141° which in this case showed it had returned to almost its original value. The sample was divided into four sections numbered 1-4. Sections 2-4 were then subjected to the same ps laser exposure as referred to above rendering the surface superhydrophilic again with a water contact angle of 0° (ps exposure 2). Again the sample was left in the air at ambient temperature for 90 hours to return to a strongly hydrophobic condition and the water contact angle measured for each section (see Table 21 below). Then sections 3 and 4 (which were previously imaged) were subjected again to the same ps laser exposure as above creating a superhydrophilic surface in these sections with a water contact angle of 0° (ps exposure 3). Again the sample was left in air at ambient conditions, this time for 74 hours until a strongly hydrophobic surface was recovered. Finally, section 4 of the surface, previously exposed three times, was subjected again to the same ps laser exposure as above to produce a superhydrophilic surface with a water contact angle of 0° (ps exposure 4). This was left in air for 72 hours until the surface was strongly hydrophobic. This data is summarized in Table 21 below. It can be seen that section 1 of the sample, exposed only once to the ps laser shows some variability in water contact angle. We can assume this is the natural variation depending on experimental error and changes in daily conditions and it amounts to an average of 134° achieved following the first exposure with a range of 24°. The total range of all the hydrophobic measurements falls within this range (of the least processed section) whilst the mean of the averages for all the hydrophobic states is 138° with a range of 13°. In other words we can conclude that there is no deleterious effect of multiple processing upon the final hydrophobic state achieved.

TABLE 21

| Water contact angle (°) | Section | | | | |
|---|---|---|---|---|---|
| Exposure | 1 | 2 | 3 | 4 | Average |
| Roughening | 0 | 0 | 0 | 0 | 0 |
| Air 3 Days | 142 | 142 | 142 | 142 | 142 |
| ps exposure 1 | 0 | 0 | 0 | 0 | 0 |
| Air 45 hours | 141 | 141 | 141 | 141 | 141 |
| ps exposure 2 | 147 | 0 | 0 | 0 | |
| Air 90 hours | 130 | 140 | 139 | 143 | 138 |
| ps exposure 3 | 132 | 134 | 0 | 0 | |
| Air 74 hours | 135 | 142 | 146 | 146 | 142 |
| ps exposure 4 | 133 | 135 | 144 | 0 | |
| Air 72 hours | 123 | 133 | 127 | 131 | 129 |

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, and drawings), and/or all of the steps of any method or process so disclosed, may be combined in any combination, except combinations where at least some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, and drawings), or to any novel one, or any novel combination, of the steps of any method or process so disclosed.

The invention claimed is:

1. A method of roughening a surface of a printing form precursor for subsequent imaging and printing processes, the method comprising subjecting substantially the entire surface of the printing form precursor to energy in the form of pulses of electromagnetic radiation to produce a uniformly hydrophilic roughened surface on at least a part of the printing form precursor and optionally converting the uniformly hydrophilic roughened surface of the printing form precursor to a uniformly hydrophobic roughened surface, wherein the pulse length of the pulses of electromagnetic radiation is up to $2.5\times10^{-7}$ s;

wherein the pulse length, pulse energy, and fluence of the pulses of electromagnetic radiation are selected to produce the uniformly hydrophilic roughened surface, or the uniformly hydrophobic roughened surface, having a roughness with an $R_a$ value measured using light interference microscopy of from 0.15 to 12 μm.

2. The method according to claim 1, wherein the method is a chemical-free method of roughening a surface of a printing form precursor.

3. The method according to claim 1, wherein the printing form precursor is an aluminium sheet.

4. The method according to claim 1, wherein the pulses of electromagnetic radiation have a pulse energy in the range of 0.05 mJ to 2.0 mJ.

5. The method according to claim 1, wherein the method comprises the step of converting the uniformly hydrophilic roughened surface of the printing form precursor to a uniformly hydrophobic roughened surface and the step of converting involves heating the surface to a temperature in the range of 30 to 150° C., after subjecting the surface to the energy.

6. The method according to claim 1, wherein the method is carried out in a controlled atmosphere.

7. The method according to claim 1, wherein the method comprises the step of converting the uniformly hydrophilic roughened surface of the printing form precursor to a uniformly hydrophobic roughened surface and the step of converting involves leaving the printing form precursor under ambient conditions or heating the surface to a temperature in the range of 30 to 150° C. for at least 15 minutes.

8. A method of providing a printing form comprising an image formed of hydrophobic regions and hydrophilic regions, the method comprising the steps of:

a) carrying out the method of claim 1 to provide a uniformly hydrophobic roughened surface or a uniformly hydrophilic roughened surface; and b) after step a), either subjecting at least a part of the uniformly hydrophobic roughened surface imagewise to a second energy in the form of pulses of electromagnetic radiation to produce at least one hydrophilic image region on the otherwise uniformly hydrophobic roughened surface; or subjecting at least a part of the uniformly hydrophilic roughened surface imagewise to a second energy in the form of pulses of electromagnetic radiation to produce at least one hydrophilic image region on the otherwise uniformly hydrophilic roughened surface and converting the hydrophilic image region to a hydrophobic image region; and thereby provide the printing form.

9. The method according to claim 8, wherein the second energy in the form of pulses of electromagnetic radiation have a pulse length of from $1\times10^{-15}$ s to $1\times10^{-6}$ s and a pulse energy of from 0.0001 mJ to 2.0 mJ.

10. The method according to claim 9, wherein step a) comprises subjecting at least a part of the surface to energy in the form of pulses of electromagnetic radiation having a pulse length of up to $2.5\times10^{-7}$ s in a controlled atmosphere to produce a uniformly hydrophilic roughened surface on the printing form precursor and converting the uniformly hydrophilic roughened surface of the printing form precursor to a uniformly hydrophobic roughened surface by heating the surface to a temperature in the range of 30 to 150° C., after subjecting the surface to the energy; and wherein step b) comprises subjecting at least a part of the uniformly hydrophobic roughened surface imagewise to a second energy in the form of pulses of electromagnetic radiation having a pulse length of from $1\times10^{-15}$ s to $1\times10^{-6}$ s to produce the at least one hydrophilic image region on the otherwise uniformly hydrophobic roughened surface.

11. The method according to claim 10, wherein in step a) after subjecting the surface to the energy the surface is heated for at least 1 minute.

12. The method according to claim 8, wherein step a) involves roughening a surface of a printing form precursor in a controlled atmosphere of an inert gas to provide the uniformly hydrophilic roughened surface; and wherein step b) comprises subjecting at least a part of the uniformly hydrophilic roughened surface imagewise to a second energy in the form of pulses of electromagnetic radiation in a controlled atmosphere of a reactive gas to produce at least one hydrophilic image region on the otherwise uniformly hydrophilic roughened surface and converting the hydrophilic image region to a hydrophobic image region by heating the surface at a temperature of 30 to 150° C. for a period of 1 minute to 24 hours.

13. A method of printing using a recycled printing form, the method comprising the steps of:

a) roughening a surface of a printing form precursor according to the method of claim 1 to provide a uniformly hydrophobic roughened surface or a uniformly hydrophilic roughened surface;

b) after step a), either subjecting at least a part of the uniformly hydrophobic roughened surface imagewise to a second energy in the form of pulses of electromagnetic radiation to produce at least one hydrophilic image region on the otherwise uniformly hydrophobic roughened surface; or subjecting at least a part of the uniformly hydrophilic roughened surface imagewise to a second energy in the form of pulses of electromagnetic radiation to produce at least one hydrophilic image region on the otherwise uniformly hydrophilic roughened surface and converting the hydrophilic image region to a hydrophobic image region; and thereby provide the printing form;

c) after step b), carrying out a method of printing using the printing form provided by step b); and d) after step c), repeating steps a) to c) at least once using the printing form used in step c).

14. A method of producing a printing form having an image from a printing form precursor, the image formed of hydrophobic regions and hydrophilic regions, the method comprising the steps of:

a) subjecting at least a first part of a surface of the printing form precursor to a first energy in the form of pulses of electromagnetic radiation to produce a uniformly hydrophilic roughened surface on at least the first part of the printing form precursor and converting the uniformly hydrophilic roughened surface to a uniformly hydrophobic roughened surface to provide the hydrophobic regions, wherein the pulse length of the pulses of electromagnetic radiation of the first energy is up to $2.5\times10^{-7}$ s, and wherein the pulse length, pulse energy, and fluence of the pulses of electromagnetic radiation of the first energy are selected to produce the uniformly hydrophobic roughened surface after conversion, having a roughness with an $R_a$ value measured using light interference microscopy of from 0.15 to 12 μm; and b) subjecting at least a second part of the surface of the printing form precursor to a second energy in the form of pulses of electromagnetic radiation to provide the hydrophilic regions, wherein the pulse length of the pulses of electromagnetic radiation of the second energy is up to $2.5\times10^{-7}$ s, and wherein the pulse length, pulse energy, and fluence of the pulses of electromagnetic radiation of the second energy are selected to produce the uniformly hydrophilic roughened surface having a roughness with an $R_a$ value measured using light interference microscopy of from 0.15 to 12 μm.

* * * * *